US006084558A

United States Patent [19]

Setoguchi et al.

[11] Patent Number: 6,084,558

[45] Date of Patent: Jul. 4, 2000

[54] DRIVING METHOD FOR PLASMA DISPLAY DEVICE

[75] Inventors: Noriaki Setoguchi; Shigeharu Asao; Yoshikazu Kanazawa, all of Kawasaki, Japan

[73] Assignee: Fujitsu Limited, Kawasaki, Japan

[21] Appl. No.: 09/157,500

[22] Filed: Sep. 21, 1998

[30] Foreign Application Priority Data

May 20, 1997 [JP] Japan ..... 10-138827

[51] Int. Cl.[7] ..... G09G 3/28

[52] U.S. Cl. ..... 345/60; 345/66; 345/68; 345/67

[58] Field of Search ..... 345/60, 66, 67, 345/68

[56] References Cited

U.S. PATENT DOCUMENTS 5,790,087 8/1998 Shigeta et al. ..... 345/67

FOREIGN PATENT DOCUMENTS 0 657 861 6/1995 European Pat. Off. .
0 762 373 3/1997 European Pat. Off. .
0 810 577 12/1997 European Pat. Off. .
7-134565 5/1995 Japan .
9-160525 6/1997 Japan .

*Primary Examiner*—Richard A. Hjerpe
*Assistant Examiner*—Kevin M. Nguyen
*Attorney, Agent, or Firm*—Staas & Halsey LLP

[57] ABSTRACT

Disclosed is a drive method that ensures normal display on a stable basis for a plasma display panel in which sustaining discharge pulses that are mutually out of phase are applied to adjoining slits in order to initiate sustaining discharge, and to thus specify display slits between an Y electrode and X electrodes across the Y electrode. A plasma display device has a display panel including first and second electrodes arranged in parallel with one another and third electrodes arranged to be orthogonal to the first and second electrodes. A slit coincident with a line formed by discharge cells is selected by applying a scanning pulse and addressing signal at an addressing step, and sustaining discharge is initiated in the selected slit at a sustaining discharge step. According to the drive method for the plasma display device, first and second slits are defined between a second electrode and first electrodes on one side and the other side of the second electrode. Interlacing is carried out by displaying lines coincident with the first slit and second slit alternately. A charge adjustment step is set between the addressing step and sustaining discharge step. At the charge adjustment step, a charge adjustment pulse is applied in order to adjust at least one of the polarity and magnitude of a wall charge accumulated due to discharge occurring at the addressing step.

20 Claims, 20 Drawing Sheets

DRIVING METHOD FOR PLASMA DISPLAY DEVICE

BACKGROUND OF THE INVENTION

1. Field of the Invention

The present invention relates to a technology for driving a display panel composed of a set of cells that are display elements possessing a memory function. More particularly, this invention is concerned with a device for displaying an image on an alternating current (AC) type plasma display panel (PDP) with interlaced scanning.

2. Description of the Related Art

In the AC type PDP, a voltage waveform is applied alternately to two sustaining electrodes in order to sustain discharge and emit light for display. One discharge is completed in one to several microseconds immediately after application of a pulse. Positively charged ions stemming from the discharge are accumulated on the surface of an insulating layer over electrodes to which a negative voltage has been applied. Likewise, electrons carrying negative charges are accumulated on the surface of the insulating layer over electrodes to which a positive voltage has been applied.

First, discharge is initiated with a pulse (writing pulse) of a high voltage (writing voltage) in order to produce a wall charge. Thereafter, a pulse (sustaining discharge pulse) of a voltage (sustaining discharge voltage) lower than the previous voltage is applied. The previously accumulated wall charge is then added to the voltage. The voltage becomes high relative to the potential in the discharge space, and exceeds the threshold of a discharge voltage. Consequently, discharge is started. In other words, once a display cell is discharged for writing, when sustaining discharge pulses of opposite polarities are applied alternately, the display cell in which a wall charge has been produced sustains discharge. This property of a display cell is referred to as a memory effect or memory function. In general, the AC type PDP utilizes the memory effect to carry out display.

In an AC type PDP of a prior art, X electrodes that are one group of sustaining electrodes and Y electrodes that are the other group thereof are arranged alternately. Discharge is initiated in regions defined between odd-numbered X electrodes and odd-numbered Y electrodes, and in regions defined between even-numbered X electrodes and even-numbered Y electrodes. In other words, display cells are defined between odd-numbered X electrodes and odd-numbered Y electrodes, and between even-numbered X electrodes and even-numbered Y electrodes. No display cells are defined between odd-numbered Y electrodes and even-numbered X electrodes, and between odd-numbered X electrodes and even-numbered Y electrodes. However, this poses a problem that it is hard to attain high definition and high luminance. The present inventor has disclosed a PDP in Japanese Unexamined Patent Publication No. 9-160525. In the PDP, for interlaced scanning, display cells are defined even between an odd-numbered Y electrodes and even-numbered X electrodes, and between odd-numbered X electrodes and even-numbered Y electrodes, and thus high definition and high luminance are attained. The present invention is adapted to a plasma display panel (PDP) in which, as in the one disclosed in the Japanese Unexamined Patent Publication No. 9-160525, discharge is initiated in regions defined between a Y electrode and X electrodes across the Y electrode in order to specify display cells.

In the PDP disclosed in the Japanese Unexamined Patent Publication No. 9-160525, after a second-half addressing period is completed, all X electrodes and Y electrodes are temporarily set to zero level. Thereafter, sustaining discharge pulses that are mutually out of phase are applied alternately to adjoining slits coincident with lines to be displayed. At this time, depending on which of the sustaining discharge pulses of opposite polarities are applied at the start of a sustaining discharge period, it is determined in which of odd-numbered ones and even-numbered ones of odd display slits coincident with lines to be displayed sustaining discharges should be initiated first. The start of sustaining discharge is delayed in the other ones of the odd display slits. The same applies to even display slits.

The luminance of a PDP depends on the frequency of sustaining discharge. For realizing a high-luminance PDP, the cycle of a sustaining discharge pulse must be short. However, as mentioned above, if an initial sustaining discharge is largely delayed, before the initial sustaining discharge is completed, the polarity of a sustaining discharge pulse is reversed. When this occurs, movement of charges between an X electrode and Y electrode deriving from sustaining discharge is not sufficiently achieved. There is a fear that subsequent sustaining discharge may not be carried out. Consequently, a normal display fails.

Moreover, the polarity of a sustaining discharge pulse applied to adjacent odd discharge slits at the time of initial sustaining discharge is opposite to that of an accumulated wall charge. A discharge occurring in an odd-numbered odd display slit will not affect a wall charge in an even-numbered odd display slit. However, when the second sustaining discharge occurs in the odd-numbered odd display slit at time instant, the polarity of a sustaining discharge pulse applied to the even-numbered odd display slit has already been reversed. Moreover, occurrence of initial sustaining discharge in the even-numbered odd display slit is delayed. This poses a problem that the wall charge in the even-numbered odd display slit disappears because of the second sustaining discharge occurring in the odd-numbered odd display slit in the meantime. When the disappearance of a wall charge occurs, sustaining discharge is not carried out. Consequently, a normal display fails.

Furthermore, during the sustaining discharge period, there is a difference of one time between the number of glows in a slit to be addressed during the first-half addressing period and the number of glows in a slit to be addressed during the second-half addressing period. The number of glows within a sub-field that is weighted a little is several times. Even the difference of one time therefore leads to a problem on gray-scale display.

Moreover, there is a problem that erase to be carried out at an erasing step succeeding the sustaining discharge period is achieved imperfectly depending on the magnitude or polarity of a charge on an electrode.

SUMMARY OF THE INVENTION

An object of the present invention is to provide a drive method that ensures normal display, on a stable basis, in a plasma display panel in which sustaining discharge pulses that are mutually out of phase are applied to adjoining slits in order to initiate sustaining discharge and to thus specify display slits between a Y electrode and X electrodes across the Y electrode.

According to the first aspect of the present invention, the drive method for plasma display panels is the drive method for the plasma display device disclosed in the Japanese Unexamined Patent Publication No. 9-160525. The plasma display device has a display panel including first and second electrodes arranged in parallel with one another, and third electrodes arranged to be orthogonal to the first and second electrodes. In the plasma display device, a slit coincident with a line formed by discharge cells is selected by applying a scanning pulse and addressing signal to second and third electrodes at an addressing step. Sustain discharge is initiated in the selected slit by applying sustaining discharge pulses to the first and second electrodes at a sustaining discharge step. According to the drive method, sustaining discharge pulses that are mutually out of phase are applied alternately to adjoining ones of the first electrodes and adjoining ones of the second electrodes. Consequently, a first slit is defined between a second electrode and a first electrode located on one side of the second electrode, and a second slit is defined between the second electrode and a first electrode located on the other side of the second electrode. Interlacing is carried out by repeating glows alternately in the first slit and second slit for display. The drive method for the plasma display device is characterized in that a charge adjustment step is set between the addressing step and sustaining discharge step. At the charge adjustment step, a charge adjustment pulse is applied in order to adjust at least one of the polarity and magnitude of a wall charge accumulated due to discharge occurring at the addressing step.

For preventing imperfect sustaining discharge derived from a delay in initial discharge succeeding the addressing step, a charge adjustment pulse whose duration is longer than the duration of a sustaining discharge pulse is applied.

The charge adjustment step may be effected both after the first-half addressing step and after the second-half addressing step. In this case, a state in which a charge adjustment pulse that is opposite in polarity to a wall charge produced at the addressing step has been applied should preferably be retained during a period after the completion of the addressing step until the sustaining discharge step is started.

To prevent a wall charge in one discharge slit from disappearing because of the second discharge occurring in the other discharge slit in which sustaining discharge occurs first, various approaches are conceivable. For example, a charge adjustment pulse for starting discharge is applied simultaneously to slits selected at the first-half addressing step and second-half addressing step. Moreover, a charge adjustment pulse is applied to the slits selected at the first-half addressing step and second-half addressing step so that discharge will be started at different time instants. In this case, a charge adjustment pulse that is opposite in polarity to a wall charge produced at the addressing step and a wall charge produced with a charge adjustment pulse, and has a small difference in voltage from the wall charges, is applied to slits other than the slit in which discharge is initiated.

Moreover, the degree of accumulation of a wall charge deriving from discharge occurring at the first-half addressing step is compared with the degree of accumulation of a wall charge deriving from discharge occurring at the second-half addressing step in advance. At the charge adjustment step, a charge adjustment pulse is applied so that a slit having a smaller wall charge will be discharged first. This ensures a more reliable occurrence of sustaining discharge.

Furthermore, selecting a discharge slit need not be carried out at the addressing step but can be carried out at the charge adjustment step. In this case, an equal voltage is applied to the first electrodes at the addressing step. The charge adjustment pulse is used to select either of the first and second slits as a slit coincident with a line to be displayed. Discharge occurring at the addressing step involves the second and third electrodes alone. At the charge adjustment step, a charge adjustment pulse is applied in order to select to which of second electrodes defining adjoining slits the charge accumulated on the second electrode should be moved. In this case, a voltage to which a dielectric layer formed over the third electrodes should be set is set to a low voltage. Thus, a charge sufficient to initiate sustaining discharge can be produced during addressing. Moreover, the voltage of the charge adjustment pulse should preferably be set to a value larger than the voltage of the sustaining discharge pulse.

Moreover, according to the second aspect of the present invention, a drive method for plasma display panels is a drive method for the plasma display device disclosed in the Japanese Unexamined Patent Publication No. 9-160525. The drive method is characterized in that each of addressing steps at which the display cells lying in the first slit and second slit are addressed includes a first-half addressing step and second-half addressing step at which lines coincident with the respective slits are interlaced, and that the sustaining discharge step is succeeded by a number-of-glow adjustment step at which the numbers of glows occurring in slits respectively addressed during the first-half addressing step and second-half addressing step, either of which is smaller, are adjusted to agree with each other. The number-of-glow adjustment step is preceded by the sustaining discharge period. A pulse is applied to a display line (display slit), in which the number of glows is small, so that the number of glows will agree with the pules that in the other display lines.

Furthermore, according to the third aspect of the present invention, the drive method for plasma display panels is the drive method for a plasma display device disclosed in the Japanese Unexamined Patent Publication No. 9-160525. The drive method is characterized in that the sustaining discharge step is succeeded by a remaining charge adjustment step at which a remaining charge adjustment pulse is applied in order to adjust at least one of the polarity and magnitude of a charge remaining at the completion of the sustaining discharge step before the remaining charge is erased at an erasing step.

According to the drive methods for plasma display panels of the second and third aspects, the duration of a sustaining discharge pulse to be applied immediately before application of a remaining charge adjustment pulse should preferably be longer than the duration of a sustaining discharge pulse. Moreover, a pulse that is opposite in polarity to a charge accumulated at the sustaining discharge step should be applied to slits other than a slit in which discharge is initiated with the remaining charge adjustment pulse. Besides, a voltage that is lower than a voltage to be applied to the slit in which discharge is initiated should be applied to the slits other than the slit in which discharge is initiated with the remaining charge adjustment pulse.

BRIEF DESCRIPTION OF THE DRAWINGS

The present invention will be more clearly understood from the description as set below with reference to the accompanying drawings, wherein.

DESCRIPTION OF THE PREFERRED EMBODIMENTS

Before proceeding to a detailed description of the preferred embodiments, a prior art plasma display panel and drive method thereof, as disclosed in the Japanese Unexamined Patent Publication No. 9-160525, will be described with reference to the accompanying drawings for a clearer understanding of the differences between the prior art and the present invention.

Figure 1:
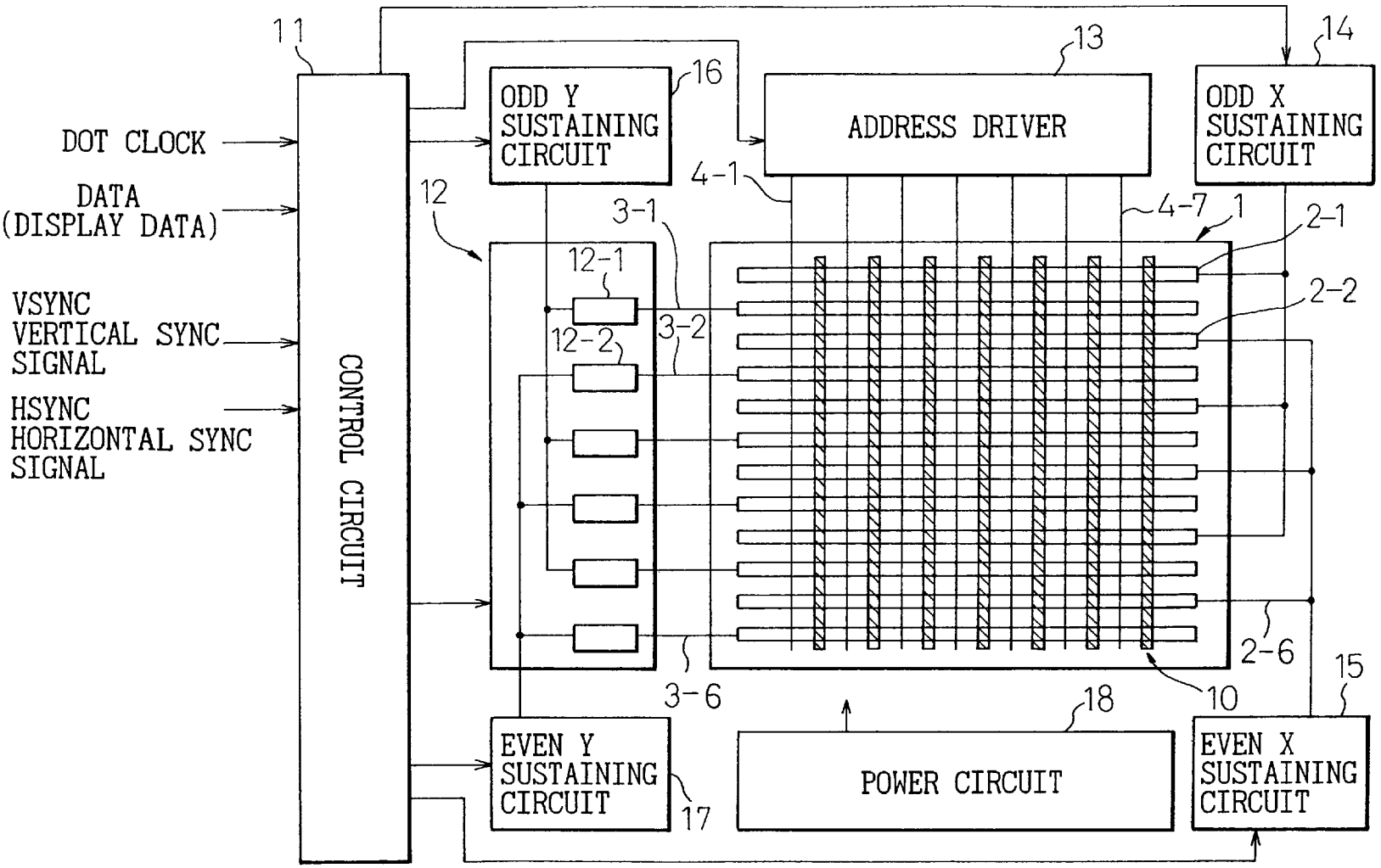
FIG. 1 is a block diagram showing a configuration of a plasma display panel (PDP) to which the present invention is adapted.
Figure 2:
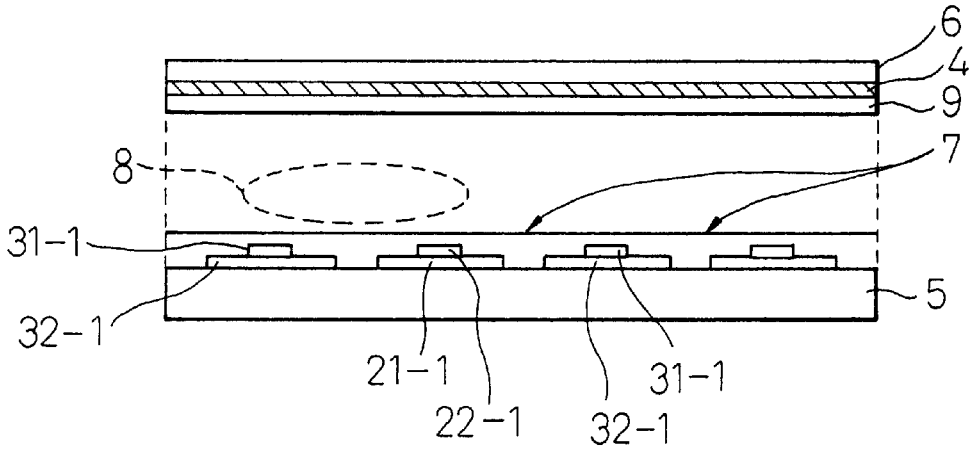
FIG. 2 is a diagram showing a sectional structure of the panel shown in FIG. 1.
Figure 3:
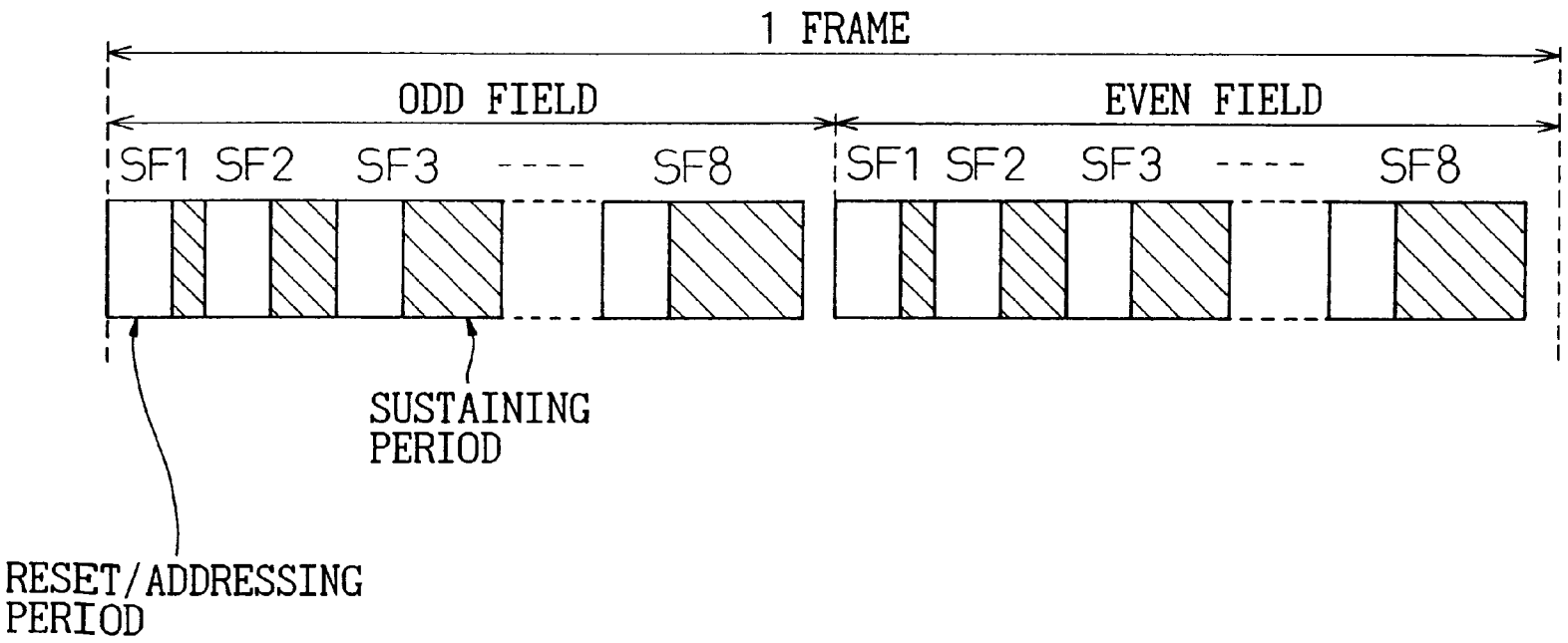
FIG. 3 is a diagram showing a structure of a display frame employed in the PDP shown in FIG. 1.
Figure 4:
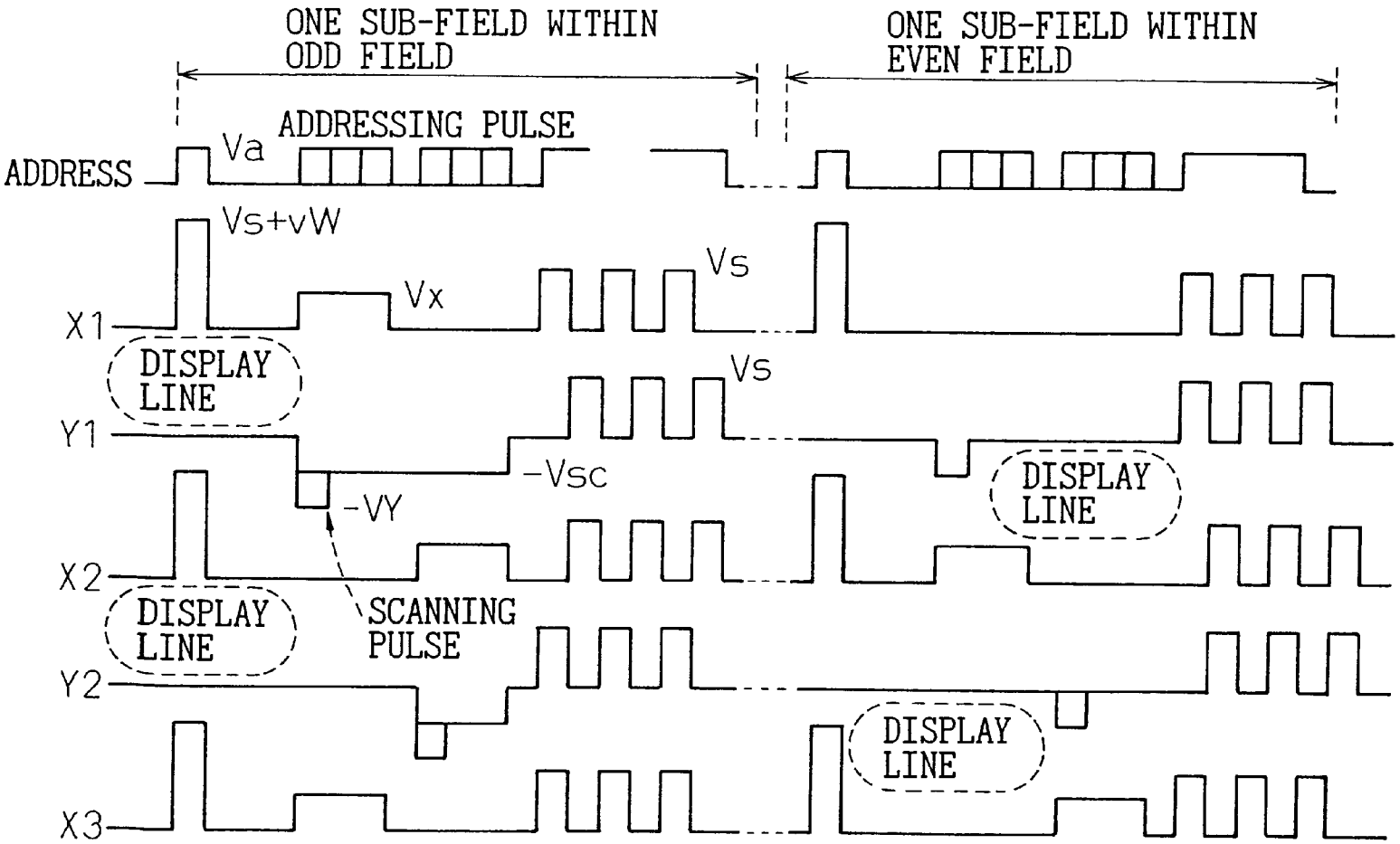
FIG. 4 is a timing chart showing the waveforms of driving signals employed in the PDP shown in FIG. 1.

FIG. 1 is a block diagram showing an overview of the PDP disclosed in the Japanese Unexamined Patent Publication No. 9-160525. FIG. 2 shows a sectional structure of the panel. FIG. 3 is a diagram showing a structure of one frame. FIG. 4 is a timing chart showing the waveforms of driving signals applied to electrodes within one sub-field. Referring to these drawings, the PDP to which the present invention is adapted will be described below.

As shown in FIG. 1, a panel 1 has first electrodes (X electrodes) 2-1, 2-2, etc. and second electrodes (Y electrodes) 3-1, 3-2, etc., which serve as sustaining discharge electrodes, and address electrodes 4-1, 4-2, etc. As shown in FIG. 2, the panel 1 is composed of two glass substrates 5 and 6. On the first substrate 6, transparent electrodes 22-1, etc. and bus electrodes 21-1, etc. which constitute the X electrodes, and transparent electrodes 32-1, 32-2, etc. and bus electrodes 31-1, 31-2, etc. which constitute the Y electrodes are arranged in parallel with one another. The substrate 5 provides a display surface. The transparent electrode is used for the purpose of transmitting light generated at a phosphor 9. However, the employment of only the transparent electrode results in a large voltage drop. The bus electrode is employed for the purpose of preventing a voltage drop caused by an electrode resistance. These electrodes are coated with a dielectric. A film made of magnesium oxide (MgO) is formed as a protective film on a discharge surface.

Moreover, address electrodes 4 are formed on the glass substrate 6 opposed to the glass substrate 5 so that the address electrodes 4 will be orthogonal to the X and Y electrodes. Moreover, a barrier 10 is formed between adjoining ones of the address electrodes. A phosphor 9 exhibiting a characteristic of glowing in red, green, and blue is formed between adjoining ones of the barriers 10 so that the phosphor 9 will cover each address electrode. The two glass substrates 5 and 6 are assembled so that the ridges of the barriers 10 will come into close contact with the MgO film.

Each electrode can be discharged to release a charge to slits 8 defined by electrodes across the electrode. In this specification, the slit 8 which is defined between electrodes and in which discharge occurs for display shall be referred to as a discharge slit. In other words, the discharge slit coincides with display cells or a line formed by the display cells. The Y electrodes are utilized mainly for selecting a display line during an addressing operation and for sustaining discharge. The address electrodes are utilized mainly for selecting display cells defined by a Y electrode coincident with the selected display line. The X electrodes are utilized mainly for selecting in which of the discharge slits across the Y electrode selected during the addressing operation addressing discharge should be initiated.

As shown in FIG. 1, the address electrodes 4-1, 4-2, etc. are connected one by one to an address driver 13. The address driver 13 applies an addressing pulse for addressing discharge. Moreover, the Y electrodes are connected individually to a scan driver 12. The scan driver 12 is divided into a portion for driving odd X electrodes 4-1, 4-3, etc. and a portion for driving even Y electrodes 4-2, 4-4, etc. in order to deal with the data bit by bit. The portions of the scan driver 12 are connected to an odd Y sustaining circuit 16 and even Y sustaining circuit 17. A pulse to be applied during an addressing operation is generated by the scan driver 12. A sustaining discharge pulse or the like is generated by the odd Y sustaining circuit 16 and even Y sustaining circuit 17, and applied to the Y electrodes by way of the scan driver 12. The X electrodes 2-1, 2-2, etc. are grouped into odd X electrodes 2-1, 2-3, etc. and even X electrodes 2-2, 2-4, etc. The groups are connected to the odd X sustaining circuit 14 and even X sustaining circuit 15 respectively. These drivers are controlled by a control circuit 11. The control circuit is controlled with synchronizing (hereinafter sync) signals and a display data signal which are input externally.

As shown in FIG. 3, a driving sequence for one frame employed in the PDP is divided into a driving sequence for an odd field and a driving sequence for an even field. During the odd field, odd lines are displayed. During the even field, even lines are displayed. In other words, during the odd field, discharge is initiated in regions defined between an odd-numbered X electrode and odd-numbered Y electrode and a region between an even-numbered X electrode and even-numbered Y electrode. During the even field, discharge is initiated in regions defined between the odd-numbered Y electrode and even-numbered x electrode, and a region between the odd-numbered X electrode and even-numbered Y electrode. Each field is divided into several sub-fields. In FIG. 3, each field is divided into eight sub-fields SF1, SF2, etc., and SF8. Each sub-field is composed of a reset period during which display cells are initialized, an addressing period during which display data is written (addressing), and a sustaining period during which only cells in which a wall charge is produced due to addressing are repeatedly discharged (sustaining discharge). During the odd field, addressing discharge and sustaining discharge are initiated for displaying an odd line alone. During the even field, addressing discharge and sustaining discharge are initiated for displaying an even line alone. The luminance of display is determined with the length of the sustaining discharge period, that is, the number of sustaining discharge pulses.

In the sub-fields SF1, SF2, etc., and SF8, the reset periods and addressing periods thereof have the same lengths. The ratio of the lengths of the sustaining discharge periods thereof is 1:2:4:8:16:32:64:128. Depending on which of the sub-fields are selected as sub-fields during which a display cell is lit, a luminance can be serd in 256 steps ranging from level 0 to level 255.

FIG. 4 is a timing chart showing the waveforms of driving signals employed in the plasma display device shown in FIG. 1. The driving signals are output during one sub-field. In this example, one sub-field is divided into a reset/addressing period, and a sustaining discharge period (sustaining period). During the reset period, first, all the Y electrodes are set to 0 V. At the same time, a whole-surface writing pulse of a voltage calculated by adding up voltages Vs and Vw (approximately 300 V) is applied to the X electrodes. The reset operation has the effect of bringing all the display cells to the same state irrespective of their being or not being lit during the previous sub-field, and is carried out in order to stabilize subsequent addressing (writing) discharge.

Thereafter, during the addressing period, addressing discharge is carried out line-sequentially in order to turn on or off the display cells according to display data. In a conventional PDP, the same voltage is applied to all X electrodes and a scanning pulse is applied sequentially to Y electrodes. However, the PDP shown in FIG. 1 operates differently. The addressing period is divided into a first-half addressing period and second-half addressing period. For example, during the first-half addressing period within the odd field, the display cells constituting the first line, fifth line, etc. are addressed. During the second-half addressing period, the display cells constituting the third line, seventh line, etc. are addressed. During the first-half addressing period within the even field, the display cells constituting the second line, sixth line, etc. are addressed. During the second-half addressing period, the display cells constituting the fourth line, eighth line, etc. are addressed.

To begin with, during the first-half addressing period within the odd field, a voltage Vx (approximately 50 V) is applied to the first, third, and other odd-numbered X electrodes, and a voltage of 0 V is applied to the second, fourth, and other even-numbered X electrodes. A scanning pulse (−VY: −150 V) is applied to the first, third, and other odd-numbered Y electrodes. At this time, the voltage of 0 V is applied to the second, fourth, and other even-numbered Y electrodes. Besides, an addressing pulse of a voltage Va (approximately 50 V) is applied selectively to the address electrodes. Consequently, discharge occurs in the regions of display cells, which are to be lit, defined between an address electrode and Y electrode. Immediately thereafter, the regions thereof defined between an X electrode and the Y electrode are discharged with the discharge as priming. The voltage Vx is applied to the odd-numbered X electrodes and the voltage of 0 V is applied to the even-numbered X electrodes. The discharge is therefore initiated in a discharge slit by the side of an X electrode to which the voltage Vx has been applied. Consequently, a wall charge permitting occurrence of sustaining discharge is accumulated on the MgO film over the X electrode and Y electrode defining the selected cells constituting the selected line. When the foregoing operation is carried out until the last Y electrode is involved, the display cells constituting the first line, fifth line, etc. are addressed.

Thereafter, during the second-half addressing period within the odd field, the voltage Vx (approximately 50 V) is applied to the second, fourth, and other even-numbered X electrodes. The voltage of 0 V is applied to the first, third, and other odd-numbered X electrodes. The scanning pulse (−VY: −150 V) is applied sequentially to the second, fourth, and other even-numbered Y electrodes. Thus, the display cells constituting the third line, seventh line, etc. are addressed. During the first-half and second-half addressing periods within the odd field, addressing the display cells constituting the first, third, fifth, and other odd-numbered lines is completed.

Thereafter, during the sustaining discharge period, a sustaining discharge pulse of a voltage Vs (approximately 180 V) is applied alternately to a Y electrode and X electrode. Sustaining discharge is then initiated. An image for one sub-field within the odd field is displayed. At this time, a voltage applied to the odd-numbered X electrode and odd-numbered Y electrode and a voltage applied to the even-numbered X electrode and even-numbered Y electrode are mutually out of phase. A potential difference Vs is therefore produced between the regions defined by an odd-numbered X electrode and odd-numbered Y electrode surrounding an odd-numbered discharge slit, and the regions defined by an even-numbered X electrode and even-numbered Y electrode surrounding an odd-numbered discharge slit. However, the potential difference Vs will not be produced between the regions defined by an odd-numbered X electrode and an even-numbered Y electrode surrounding an even-numbered discharge slit, and the regions defined by an even-numbered X electrode and an odd-numbered Y electrode surrounding an even-numbered discharge slit. Thus, sustaining discharge is initiated only in the display cells constituting an odd-numbered line.

Likewise, during the even field, the display cells constituting an even-numbered line are dealt with for displaying an image. As mentioned above, display cells are specified between an Y electrode and X electrodes across the Y electrode. Although the panel has a structure similar to the one of the prior art, the panel can achieve higher-definition display.

Figure 5:
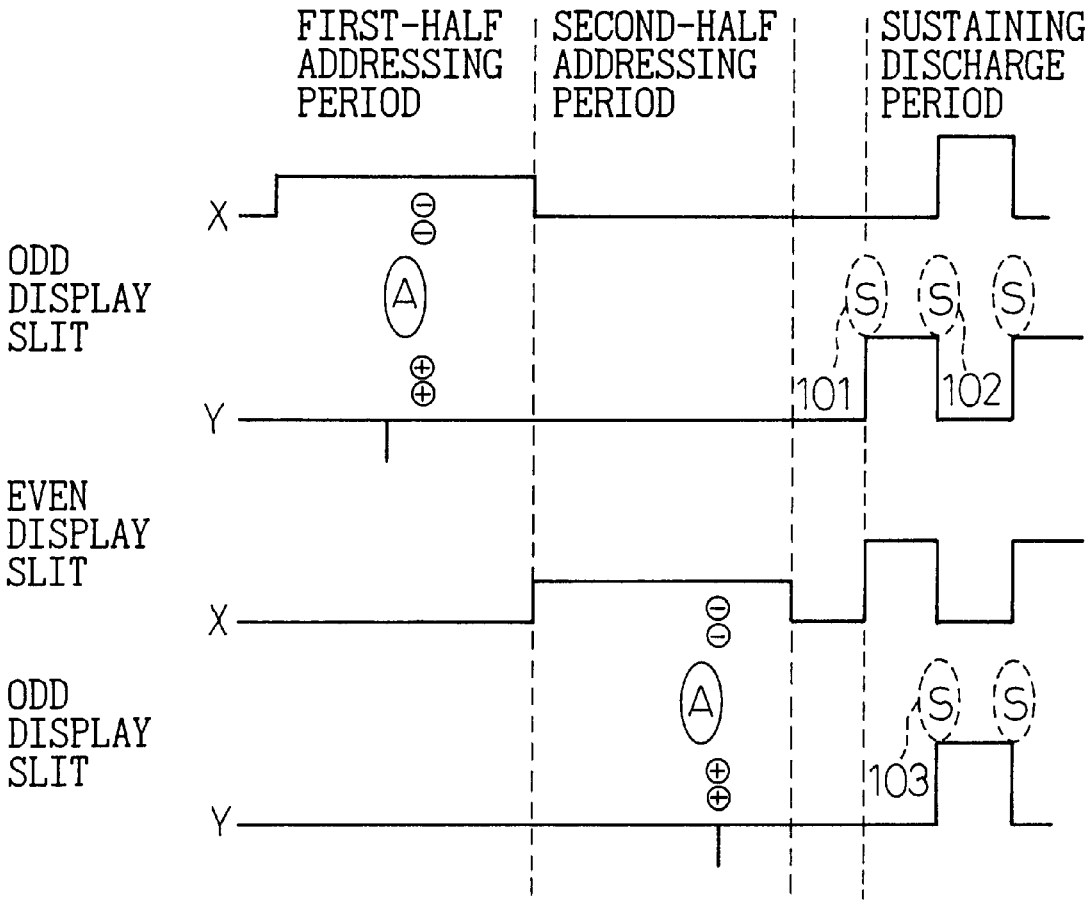
FIG. 5 is a diagram for explaining an underlying problem of a prior art.

As mentioned above, in the PDP disclosed in the Japanese Unexamined Patent Publication No. 9-160525, discharge is initiated in regions defined between a Y electrode and X electrodes across the Y electrode, and display cells are thus specified. After the first-half addressing period and second-half addressing period, sustaining discharge is initiated by applying sustaining discharge pulses, which are mutually out of phase, to adjoining slits. FIG. 5 is a diagram showing a state attained between the addressing period and sustaining discharge period.

As shown in FIG. 5, according to the prior art, after the second-half addressing period is completed, all the X electrodes and Y electrodes are temporarily set to a zero level. Thereafter, sustaining discharge pulses that are mutually out of phase are applied alternately to adjoining slits to be involved in display. For example, for initiating discharge in an odd display slit during the odd field, the display cells lying in an odd-numbered one of odd display slits, that is, in the (4n+1)-th (where n denotes an integer equal to or larger than 0) slit are addressed during the first-half addressing period. The display cells lying in an even-numbered one of the odd display slits, that is, in the (4n+3)-th (where n denotes an integer equal to or larger than 0) slit are addressed during the second-half addressing period. Thus, a negative charge is accumulated on an X electrode and a positive charge is accumulated on a Y electrode. During the sustaining discharge period, a low-voltage sustaining discharge pulse is applied to the odd-numbered X electrode, and a high-voltage sustaining discharge pulse is applied to the even-numbered X electrode. A high-voltage sustaining discharge pulse is applied to the odd-numbered Y electrode, and a low-voltage sustaining discharge pulse is applied to the even-numbered Y electrode. Accordingly, initial sustaining discharge 101 occurs in the odd-numbered one of the odd display slits. Thereafter, the sustaining discharge pulses are reversed. Consequently, a high-voltage sustaining discharge pulse is applied to the odd-numbered x electrode, and a low-voltage sustaining discharge pulse is applied to the even-numbered X electrode. A low-voltage sustaining discharge pulse is applied to the odd-numbered Y electrode, and a high-voltage sustaining discharge pulse is applied to the even-numbered Y electrode. Accordingly, sustaining discharge 102 occurs in the odd-numbered one of the odd display slits. Sustaining discharge 103 occurs in the even-numbered one of the odd display slits. Thus, depending on which polarity a sustaining discharge pulse to be applied first during the sustaining discharge period has, it is determined in which of the odd-numbered one and even-numbered one of the odd display slits coincident with a line to be displayed sustaining discharge should be started first. In the other slits, start of sustaining discharge is delayed. The same applies to even display slits. An example of displaying a line coincident with an odd display slit during the odd field will be described below.

Figure 6:
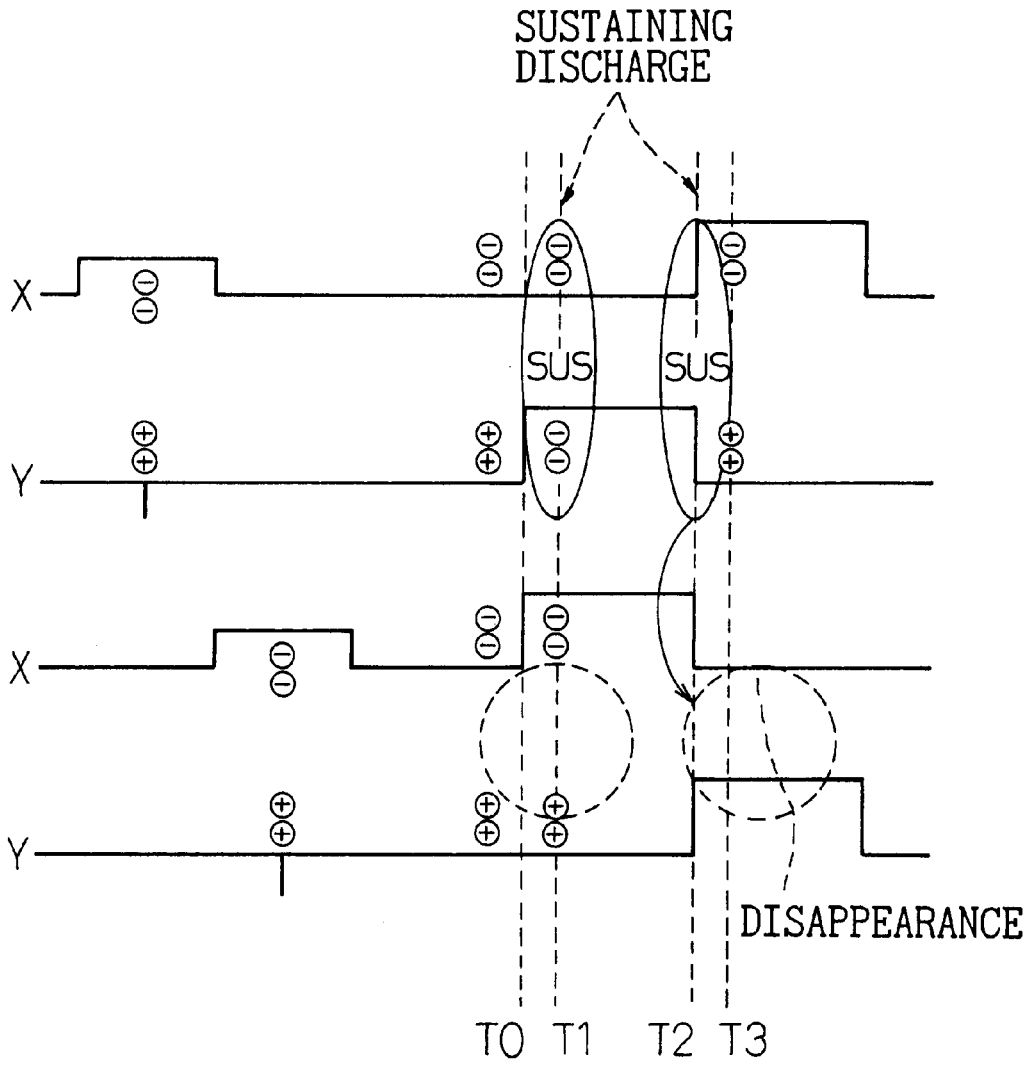
FIG. 6 is a diagram for explaining an underlying problem of the prior art.

An adverse effect of a delay in start of sustaining discharge will be described with reference to FIG. 6. As mentioned above, a sustaining discharge pulse rises first at time instant T0. Initial sustaining discharge succeeding addressing is largely delayed. In an odd-numbered odd display slit, sustaining discharge is started at time instant T1. At this time, sustaining discharge does not occur in an even-numbered odd display slit. At time instant T2, the polarity of a sustaining discharge pulse is reversed. In the odd-numbered odd display slit, the second sustaining discharge is initiated immediately. However, in the even-numbered odd display slit, discharge delayed because it is an initial sustaining discharge. Discharge is started at time instant T4.

The luminance of the PDP depends on the number of sustaining discharge. For realizing a high-luminance PDP, the cycle of a sustaining discharge pulse must be short. Therefore, if the initial sustaining discharge is largely delayed as mentioned above, before the initial sustaining discharge is completed, the polarity of a sustaining discharge pulse is reversed. When this takes place, the movement of a charge between an X electrode and Y electrode deriving from sustaining discharge is not achieved successfully. There is some fear that subsequent sustaining discharge may not be carried out and the normal display may fail.

Moreover, a sustaining discharge pulse applied to an adjoining odd discharge slit at the time instant T1 of initial sustaining discharge is opposite in polarity to an accumulated wall charge. Discharge occurring in an odd-numbered odd display slit will not affect the wall charge accumulated in an adjoining even-numbered odd display slit. However, when the second sustaining discharge occurs in the odd-numbered odd display slit at time instant T2, the polarity of a sustaining discharge pulse applied to the even-numbered odd display slit has already been reversed. Moreover, occurrence of initial sustaining discharge in the even-numbered odd display slit is delayed. This poses a problem that the wall charge in the even-numbered odd display slit disappears because of the second sustaining discharge occurring in the odd-numbered odd display slit. When the disappearance of a wall charge takes place, sustaining discharge will not be achieved. Consequently, the normal display fails.

As shown in FIG. 5, during the sustaining discharge period, there is a difference of one time between the number of glows occurring in a slit to be addressed during the first-half addressing period and the number of glows occurring in a slit to be addressed during the second-half addressing period. The number of glows during a sub-field of low weight is several times. Even the difference of one time poses a problem on gray-scale display.

Moreover, at the erasing step succeeding the sustaining discharge period, there is a problem that erasing is achieved imperfectly depending on the magnitude and polarity of a charge accumulated on an electrode.

Figure 7:
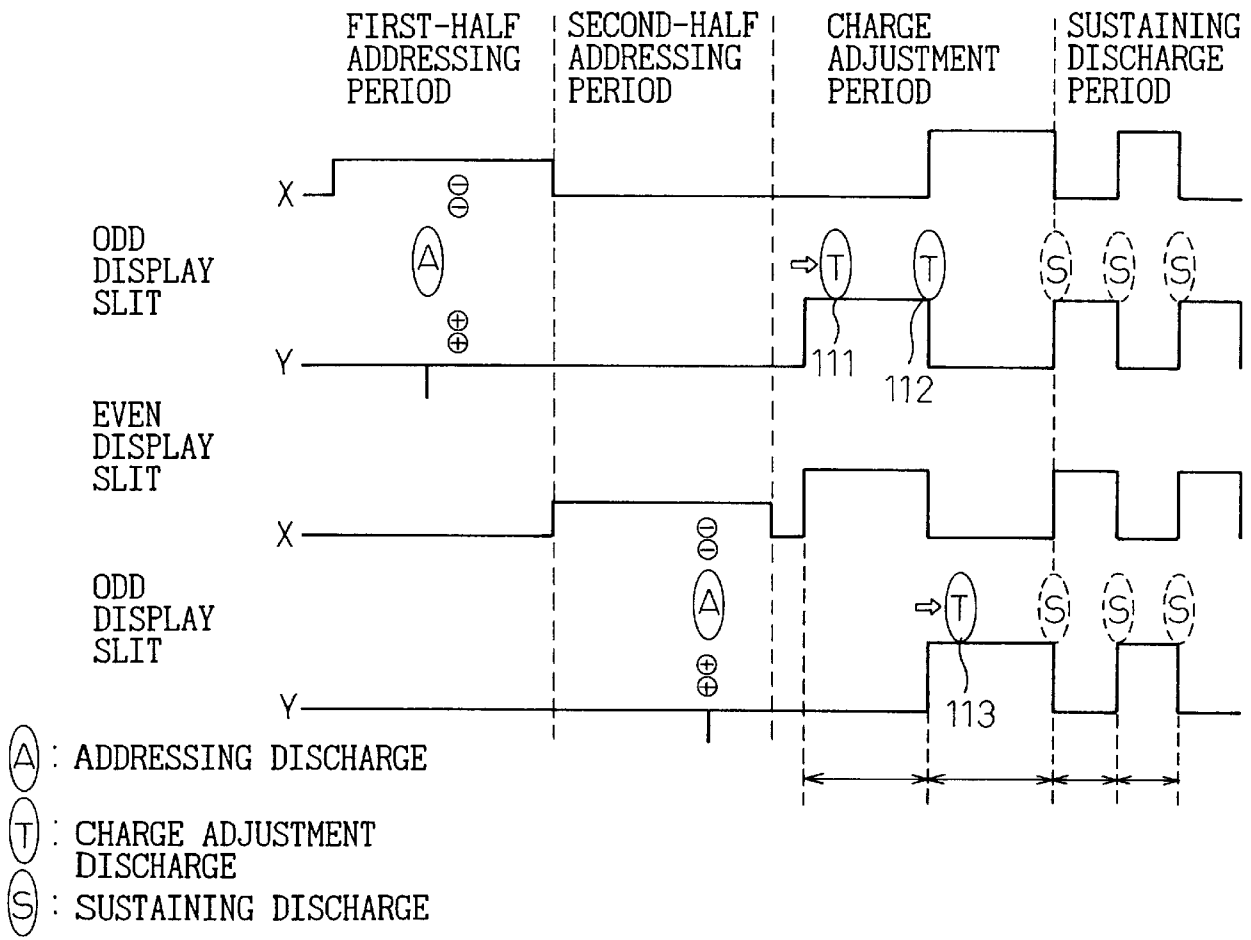
FIG. 7 is a timing chart showing the waveforms of driving signals employed in the first embodiment of the present invention.

FIG. 7 is a diagram showing a sequence of driving the plasma display panel (PDP) in accordance with the first embodiment of the present invention. The PDP concerned is that of the plasma display device disclosed in Japanese Unexamined Patent Publication No. 9-160525. The fundamental drive method has already been described. Herein, only a difference will be described. In the drawing, A denotes addressing discharge. T denotes a charge adjustment pulse, and S denotes sustaining discharge. The other embodiments are also concerned with the PDP. The description of the PDP will be omitted.

As apparent from the comparison with FIG. 5, a charge adjustment period is set between the second-half addressing period and sustaining discharge period. Discharge occurring during the charge adjustment period, like sustaining discharge, contributes to luminance. The charge adjustment period is equivalent to the first part of the sustaining discharge period. As illustrated, the charge adjustment pulse to be applied during the charge adjustment period has the same polarity and strength as a sustaining discharge pulse employed the prior art, but has a longer duration than the sustaining discharge pulse. By applying such a charge adjustment pulse, the potential at a Y electrode defining an odd display slit rises in the same manner as that in the prior art. Initial discharge T111 occurring in the odd display slit delays. The polarity of a sustaining discharge pulse is then reversed. The second sustaining discharge 112 is initiated immediately in the odd-numbered odd display slit. However, in an even-numbered odd display slit, since the discharge is initial sustaining discharge, the discharge 113 is delayed. However, since the duration of the charge adjustment pulse is long, after the discharge 113 occurs, it takes much time for the charge adjustment pulse to reverse in polarity in response to the next sustaining discharge pulse. The delay in discharge 113 will therefore not be affected by the next sustaining discharge pulse.

As mentioned above, the duration of the charge adjustment pulse to be applied during the charge adjustment period is longer than that of the sustaining discharge pulse, that is, the duration of the initial sustaining discharge pulse is longer. Consequently, it will not occur that initial sustaining discharge is affected by the next sustaining discharge pulse because of a delay. Sustaining discharge can be initiated successfully in all display slits.

Figure 8:
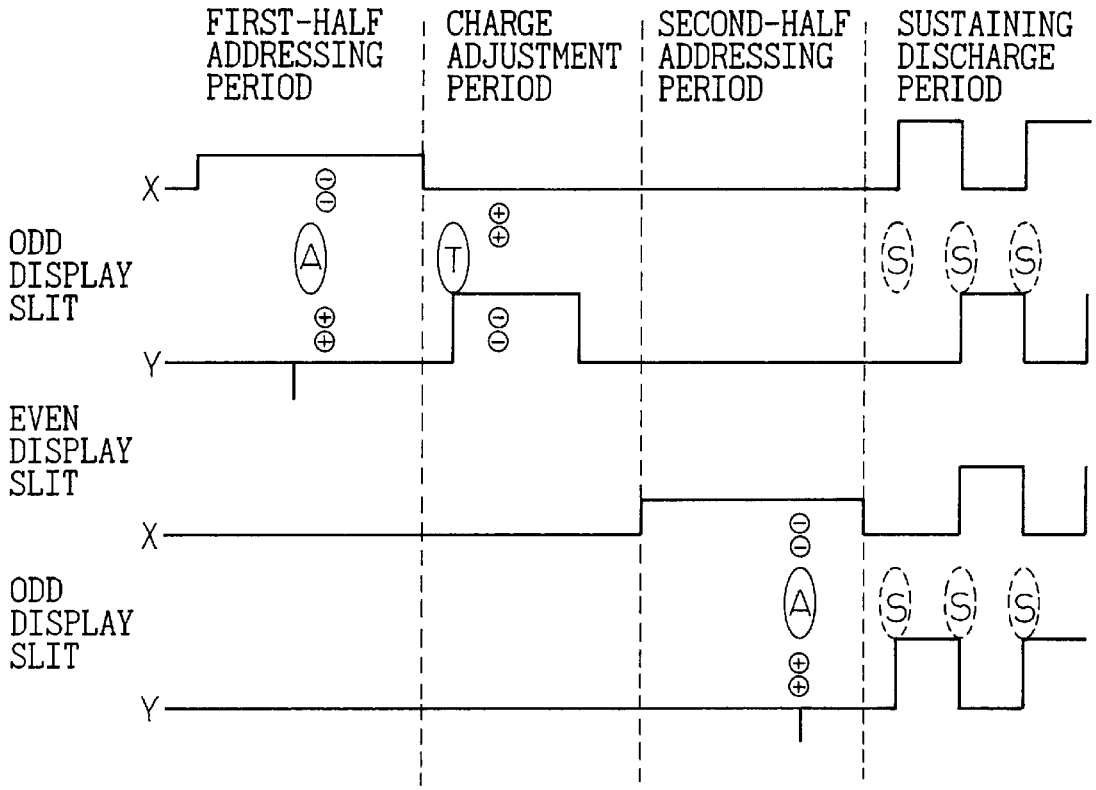
FIG. 8 is a timing chart showing the waveforms of driving signals employed in the second embodiment of the present invention.

FIG. 8 is a diagram showing a sequence of driving a PDP in accordance with the second embodiment of the present invention. According to this embodiment, the first-half addressing period is succeeded by a charge adjustment period. Only one charge adjustment pulse is applied to an odd-numbered odd display slit. Consequently, charges accumulated on an X electrode and Y electrode defining the odd-numbered odd display slit during the first-half addressing period are exchanged for each other. In other words, during addressing, a negative charge is accumulated on an X electrode, and a positive charge is accumulated on the Y electrode. With the charge adjustment pulse, a positive charge is accumulated on the X electrode and a negative charge is accumulated on the Y electrode. At this time, the charge adjustment pulse is not applied to an even-numbered odd display slit. Nothing occurs in the even-numbered odd display slit. Thereafter, a charge is accumulated on the X electrode and Y electrode defining the even-numbered odd display slit. At this time instant, the polarity of the charges on the X electrode and Y electrode defining the odd-numbered odd display slit is opposite to that of the charges on the X electrode and Y electrode defining the even-numbered odd display slit. When the sustaining discharge pulse for initiating discharge first in the even-numbered odd display slit is applied as illustrated, sustaining discharge occurs simultaneously in both the odd display slits.

Similarly to the first embodiment, the duration of a sustaining discharge pulse to be applied first after the second-half addressing period may be made longer than that of the other sustaining discharge pulses. Thus, the adverse effect of the delay in initial sustaining discharge to be initiated in the even-numbered odd display slit can be nullified.

Figure 9:
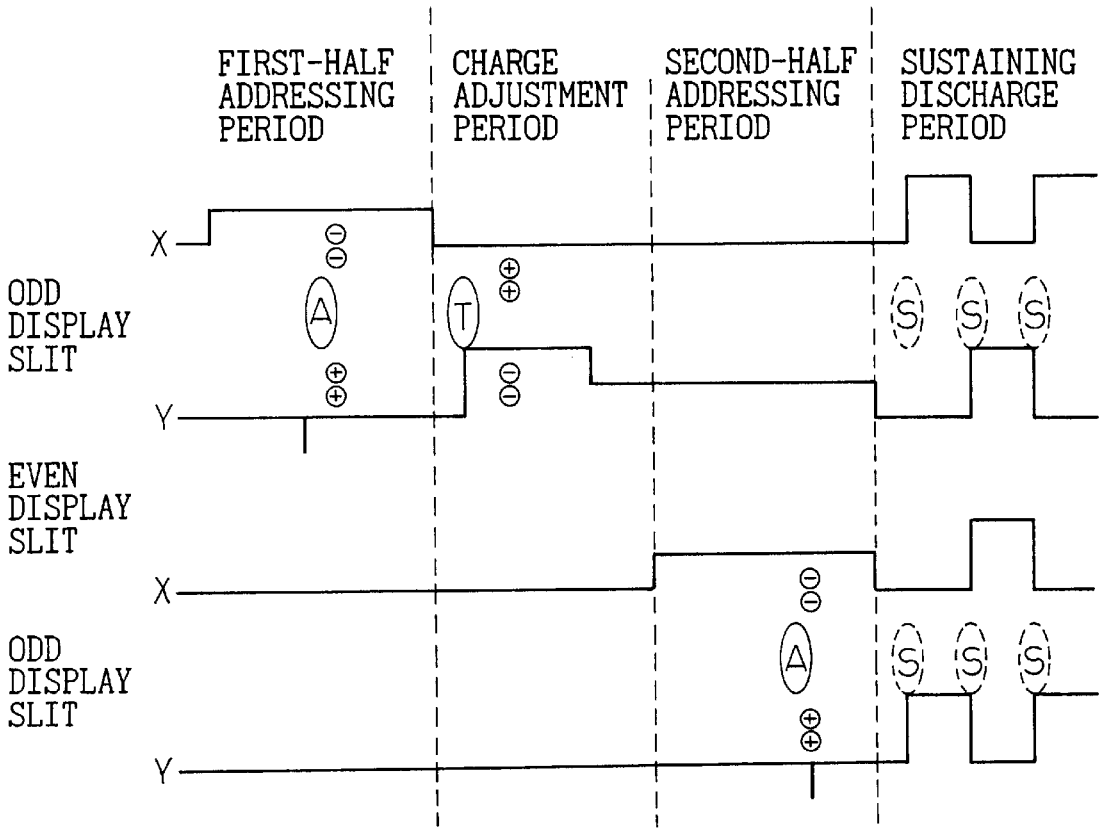
FIG. 9 is a timing chart showing the waveforms of driving signals employed in the third embodiment of the present invention.

FIG. 9 is a diagram showing a sequence of driving a PDP in accordance with the third embodiment of the present invention. According to this embodiment, similarly to the second embodiment, the first-half addressing period is succeeded by a charge adjustment period. Moreover, after a charge adjustment pulse is applied to an odd-numbered odd display slit, the potential at an Y electrode is retained at an intermediate level until the second-half addressing period is completed. Thus, a charge accumulated in the odd-numbered odd display slit can be prevented from disappearing during the second-half addressing period. Incidentally, the intermediate level is an appropriate intermediate level between 0 V and the voltage of a sustaining discharge pulse.

Figure 10:
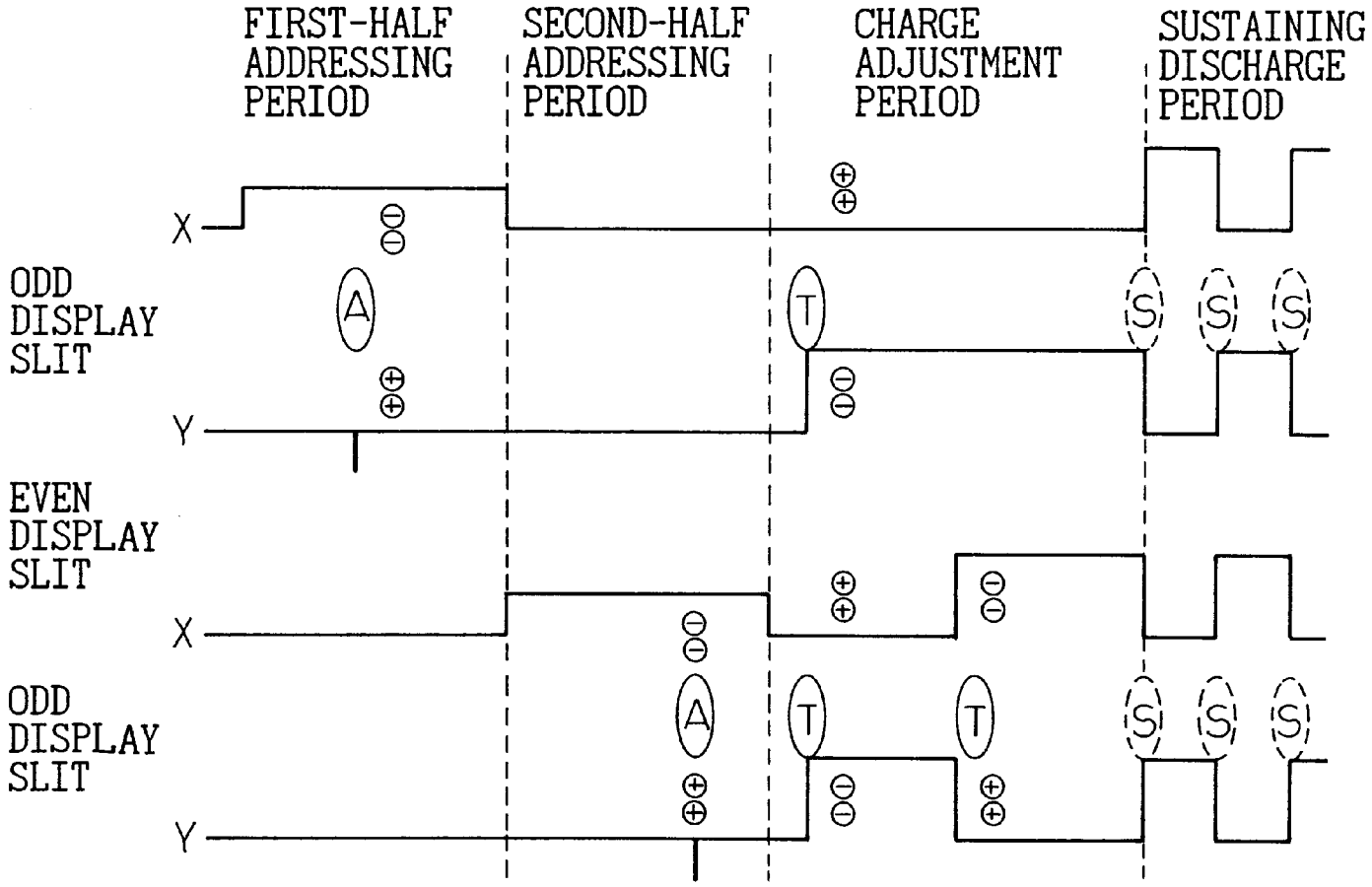
FIG. 10 is a timing chart showing the waveforms of driving signals employed in the fourth embodiment of the present invention.

FIG. 10 is a diagram showing a sequence of driving a PDP in accordance with the fourth embodiment of the present invention. According to this embodiment, a charge adjustment period is set between the second-half addressing period and sustaining discharge period. After a charge adjustment pulse for initiating discharge simultaneously in both even-numbered and odd-numbered odd display slits is applied, the polarity of a pulse applied to either the even-numbered or odd-numbered odd display slits is reversed. In the drawing, the polarity of the pulse applied to the even-numbered odd display slits is reversed. At the time of reversing the polarity, discharge occurs in the even-numbered odd display slit. The succeeding sustaining discharge period is identical to that in the prior art.

According to the fourth embodiment, application of the charge adjustment pulse leads to application of a voltage causing discharge in an even display slit. However, since the polarity of a charge accumulated in the even display slit is opposite to that in an odd display slit, no discharge occurs.

Figure 11:
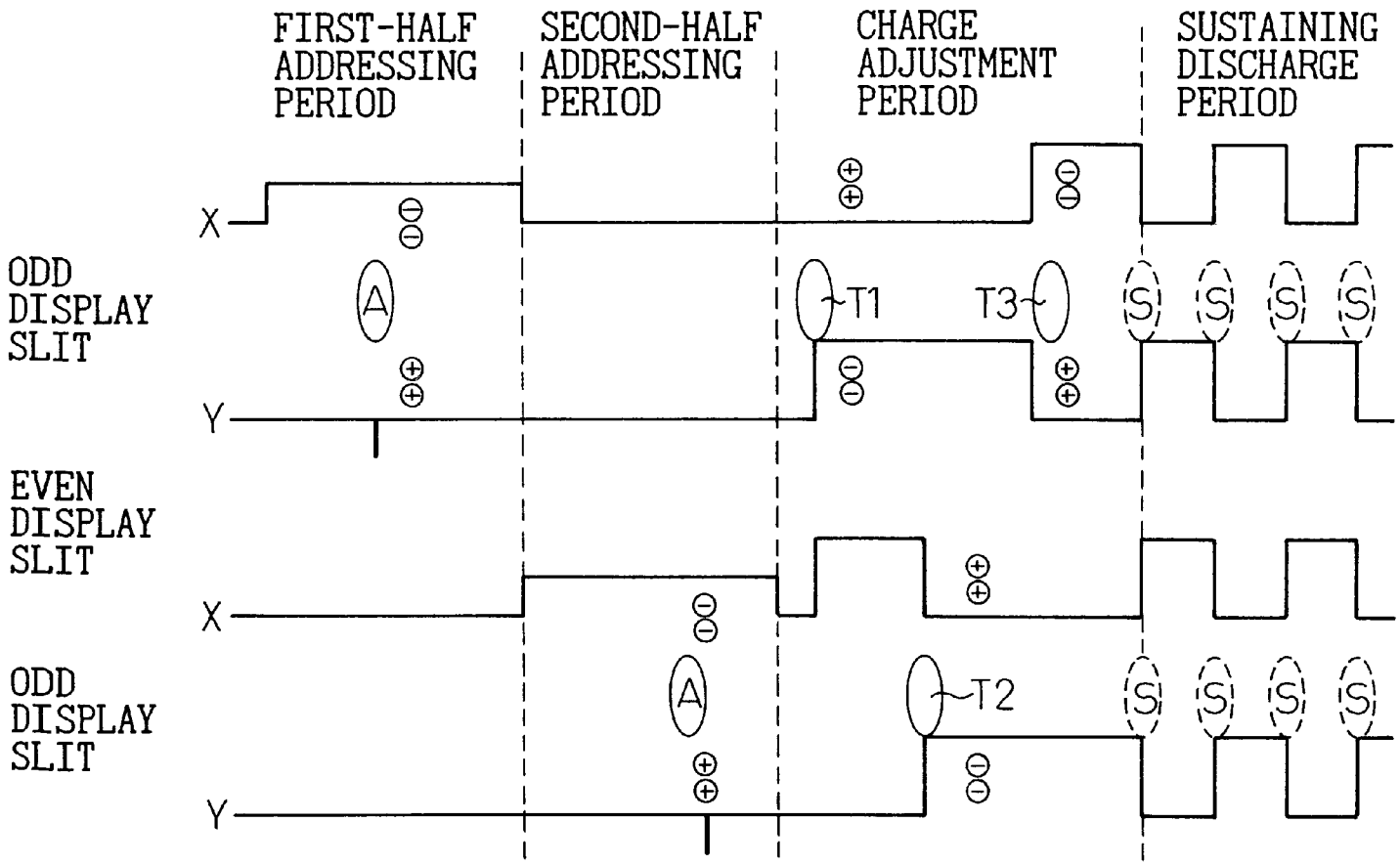
FIG. 11 is a timing chart showing the waveforms of driving signals employed in the fifth embodiment of the present invention.

FIG. 11 is a diagram showing a sequence of driving a PDP in accordance with the fifth embodiment of the present invention. According to this embodiment, a charge adjustment period is set between the second-half addressing period and sustaining discharge period. After initial discharge is initiated separately in odd display slits, the polarities of accumulated charges are adjusted. The sustaining discharge period is then started. Specifically, a charge adjustment pulse is applied to an odd-numbered odd display slit. This initiates initial discharge T1. At this time, a pulse whose polarity is opposite to that of a held charge is applied to an even-numbered odd display slit. Thereafter, a charge adjustment pulse is applied to the even-numbered odd display slit in order to initiate initial discharge T2. When the discharge T2 is initiated, no charge adjustment pulse is applied to the odd-numbered odd display slit. Discharge therefore does not occur in the odd-numbered odd display slit. The charge in the even-numbered odd display slit will not disappear. Thereafter, the polarity of the pulse applied to the odd-numbered odd display slit is reversed. The normal sustaining discharge period is then started. Thus, initial discharge is initiated separately in both the odd display slits. Disappearance of a charge will not take place.

Figure 12:
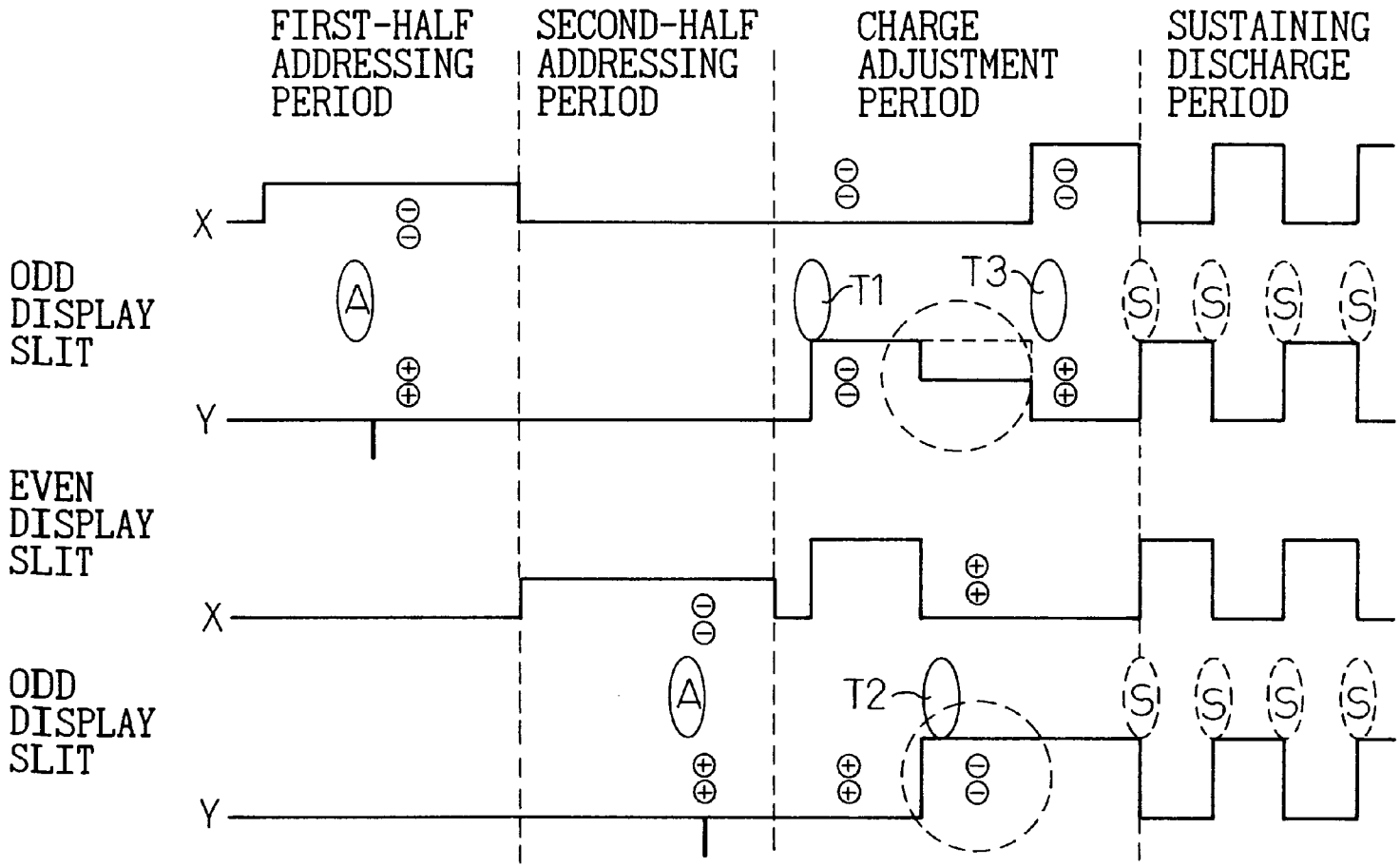
FIG. 12 is a timing chart showing the waveforms of driving signals employed in the sixth embodiment of the present invention.

FIG. 12 is a diagram showing a sequence of driving a PDP in accordance with the sixth embodiment of the present invention. This embodiment is similar to the fifth embodiment wherein, when initial discharge T2 is initiated in the even-numbered odd display slit, a voltage to be applied to the odd-numbered odd display slit is set to a low voltage. Thus, the possibility of occurrence of discharge in an even display slit is reduced.

Figure 13:
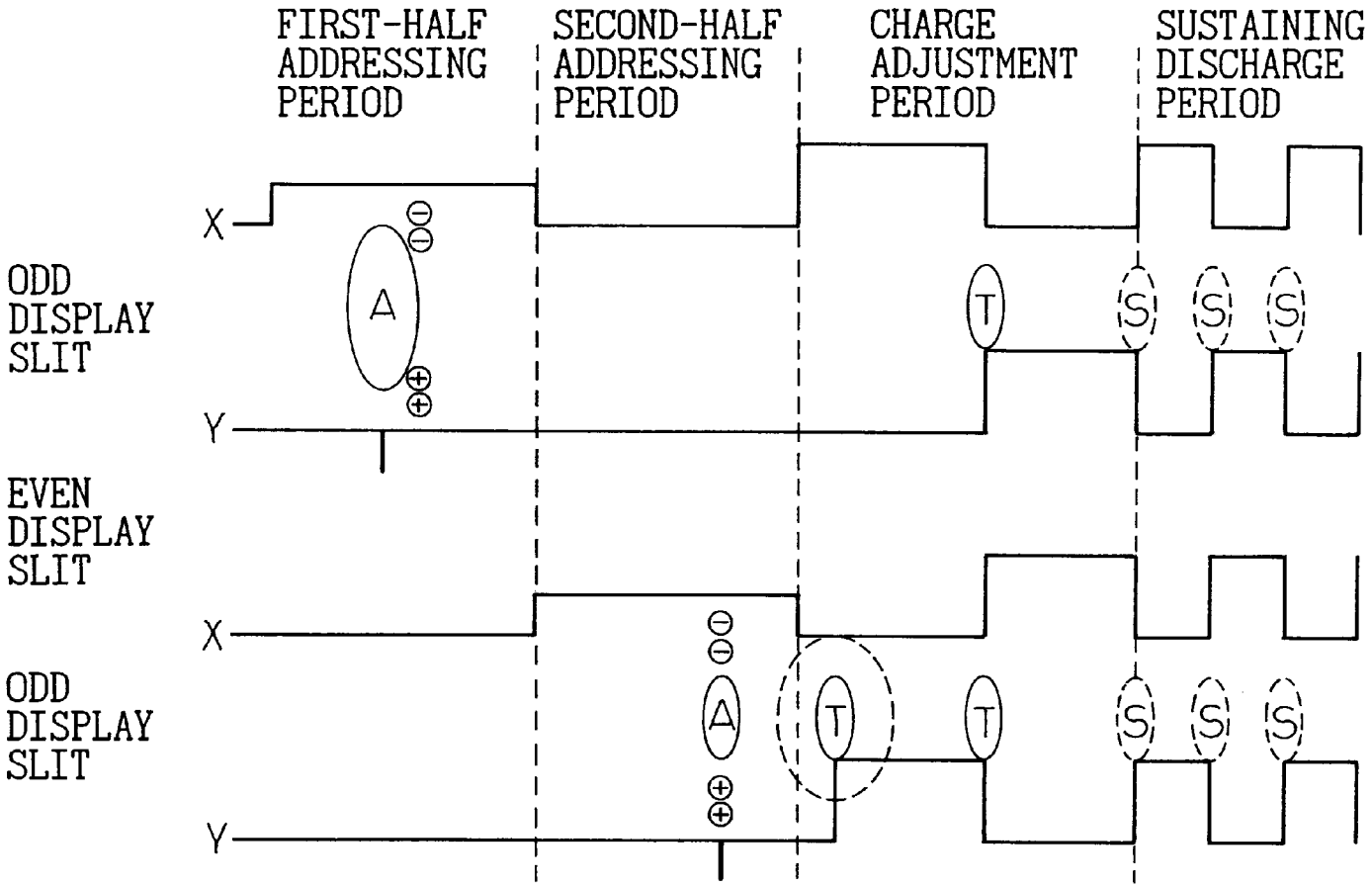
FIG. 13 is a timing chart showing the waveforms of driving signals employed in the seventh embodiment of the present invention.

FIG. 13 is a diagram showing a sequence of driving a PDP in accordance with the seventh embodiment of the present invention. This embodiment is similar to the first embodiment, wherein initial discharge is initiated first in an even-numbered odd display slit. In which of odd-numbered and even-numbered odd display slits initial discharge should be initiated first is determined by comparing the magnitude of addressing discharge occurring in the odd-numbered odd display slit with the one occurring in the even-numbered odd display slit in advance. Discharge is initiated first in a display slit in which a smaller magnitude of addressing discharge has occurred. Depending on an initialization mode for a wall charge, the magnitude of addressing discharge differs between the odd-numbered and even-numbered odd display slits. The same applies to even display slits. This difference leads to a difference in wall charge. When discharge to be carried out first after the completion of the addressing period is initiated in an odd-numbered or even-numbered odd display slit in which a smaller magnitude of addressing discharge has occurred, the possibility of disappearance of a charge decreases. A margin for driving can thus be preserved.

Figure 14:
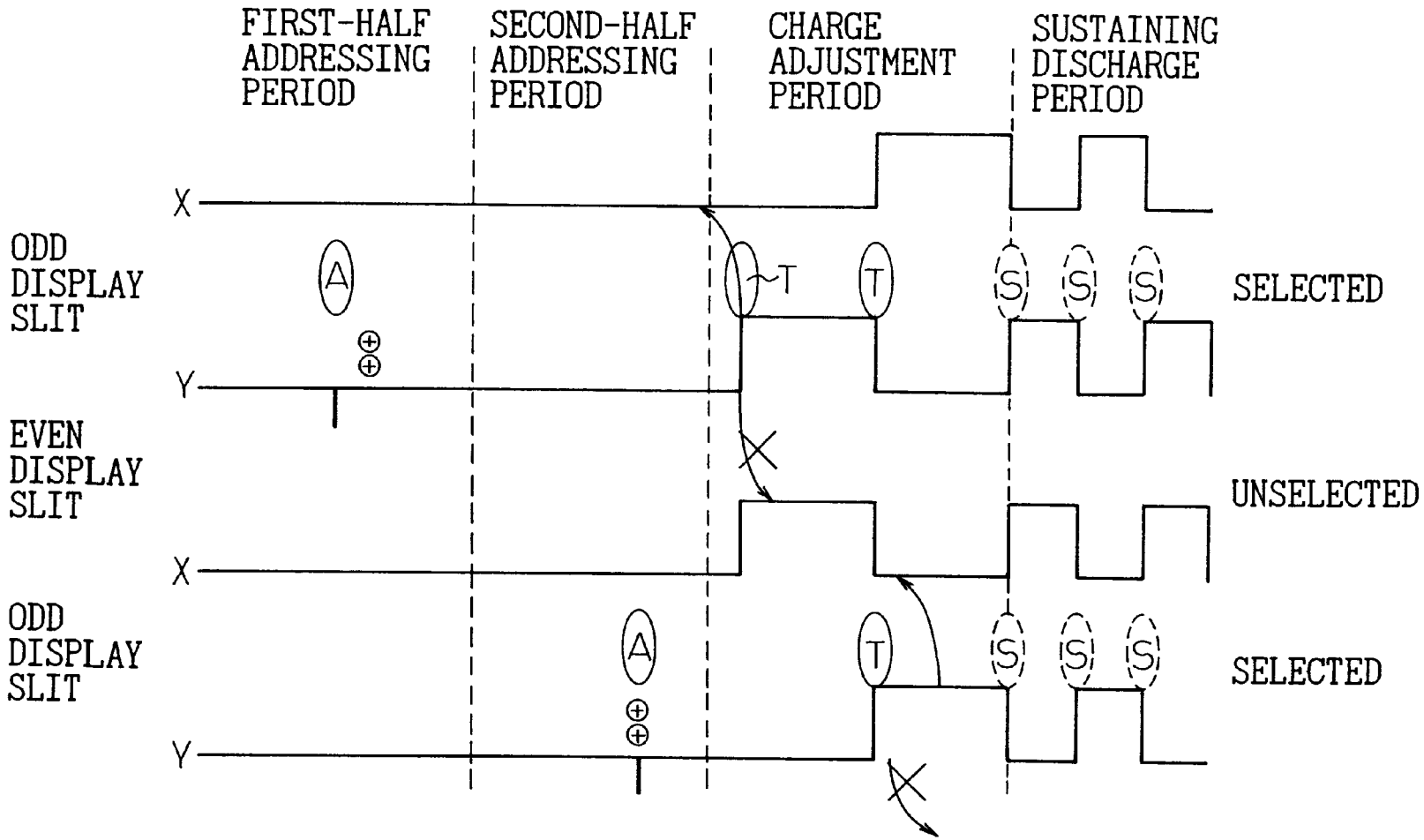
FIG. 14 is a timing chart showing the waveforms of driving signals employed in the eighth embodiment of the present invention.
Figure 15:
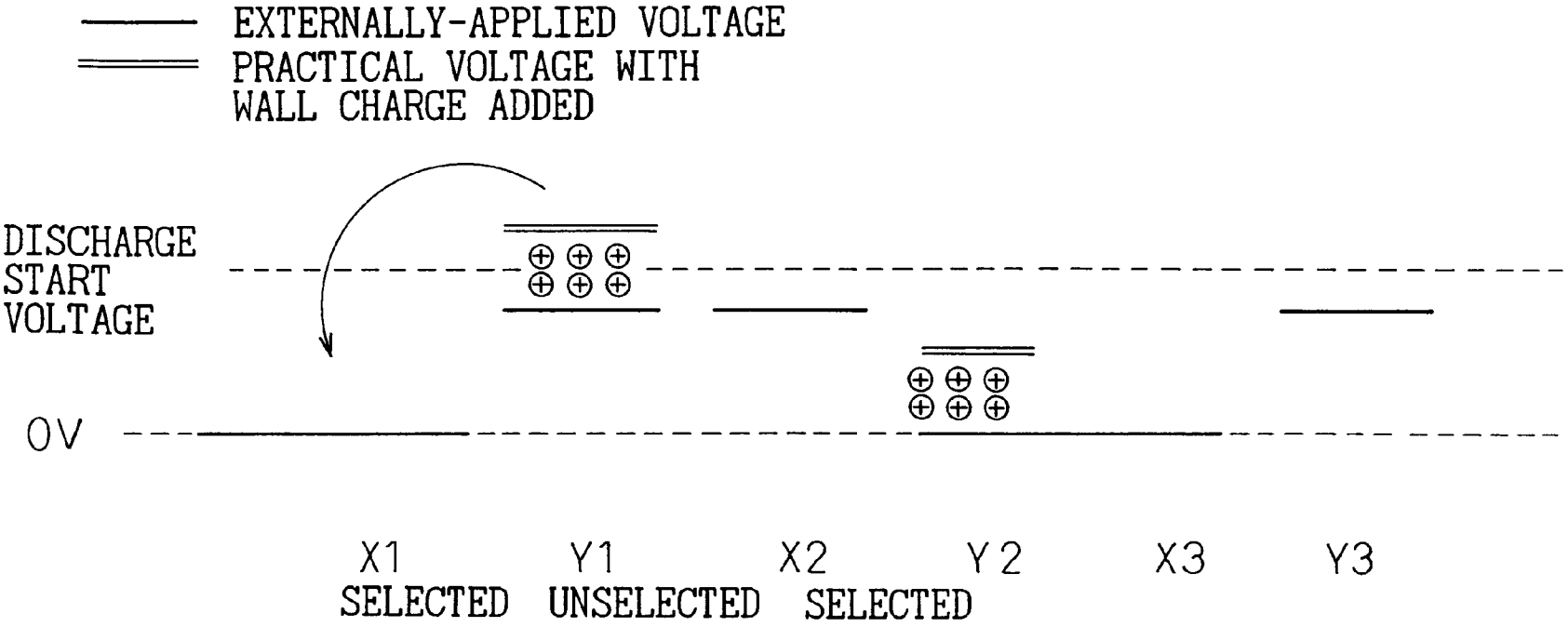
FIG. 15 is a diagram for explaining the operations of the eighth embodiment.

FIG. 14 is a diagram showing a sequence of driving a PDP in accordance with the eighth embodiment of the present invention. FIG. 15 is a diagram for explaining the principles of selecting a slit in the eighth embodiment. In the prior art and aforesaid embodiments, during the first-half addressing period and second-half addressing period, a discharge slit is selected depending on which of the potentials at odd-numbered and even-numbered X electrodes is higher. In the eighth embodiment, the selection is carried out during the charge adjustment period. The potential at an X electrode is retained at 0 V during the first-half addressing period and second-half addressing period. A scanning pulse is applied to a Y electrode, and an addressing pulse is applied to an address electrode. Thus, addressing discharge is initiated. Surface discharge to be triggered by the addressing discharge will therefore not occur to involve the X electrode and Y electrode. A charge is accumulated on the Y electrode alone. During the charge adjustment period, either of an odd display slit and even display slit is selected as a slit in which discharge is initiated. Specifically, discharge is initiated in a slit to which a charge adjustment pulse of the same polarity as a charge accumulated on the Y electrode has been applied. No discharge is initiated in a slit to which a charge adjustment pulse of opposite polarity has been applied. In the drawing, an odd-numbered odd display slit is discharged with the first charge adjustment pulse. An even-numbered odd display slit is discharged with the next charge adjustment pulse. Thus, the odd display slits are selected.

As shown in FIG. 15, the potentials at electrodes Y1 and X2 are set to a high potential lower than a discharge start voltage, and the potentials at electrodes X1 and Y2 are set to 0 V. A positive charge is added to the potential at the electrode Y1. The potential at the electrode Y1 therefore exceeds the threshold of the discharge start voltage. Discharge is then initiated in the regions between the electrodes X1 and Y1. However, the potentials at the other electrodes do not exceed the threshold of the discharge start voltage. Discharge will therefore not occur. Thereafter, the potentials at the electrodes X1 and Y2 are set to a high potential lower than the discharge start voltage, and the potentials at the electrodes X2 and Y1 are set to 0 V. Discharge is then initiated in the regions between the electrodes X2 and Y2. Thus, an odd display slit is selected.

Figure 16:
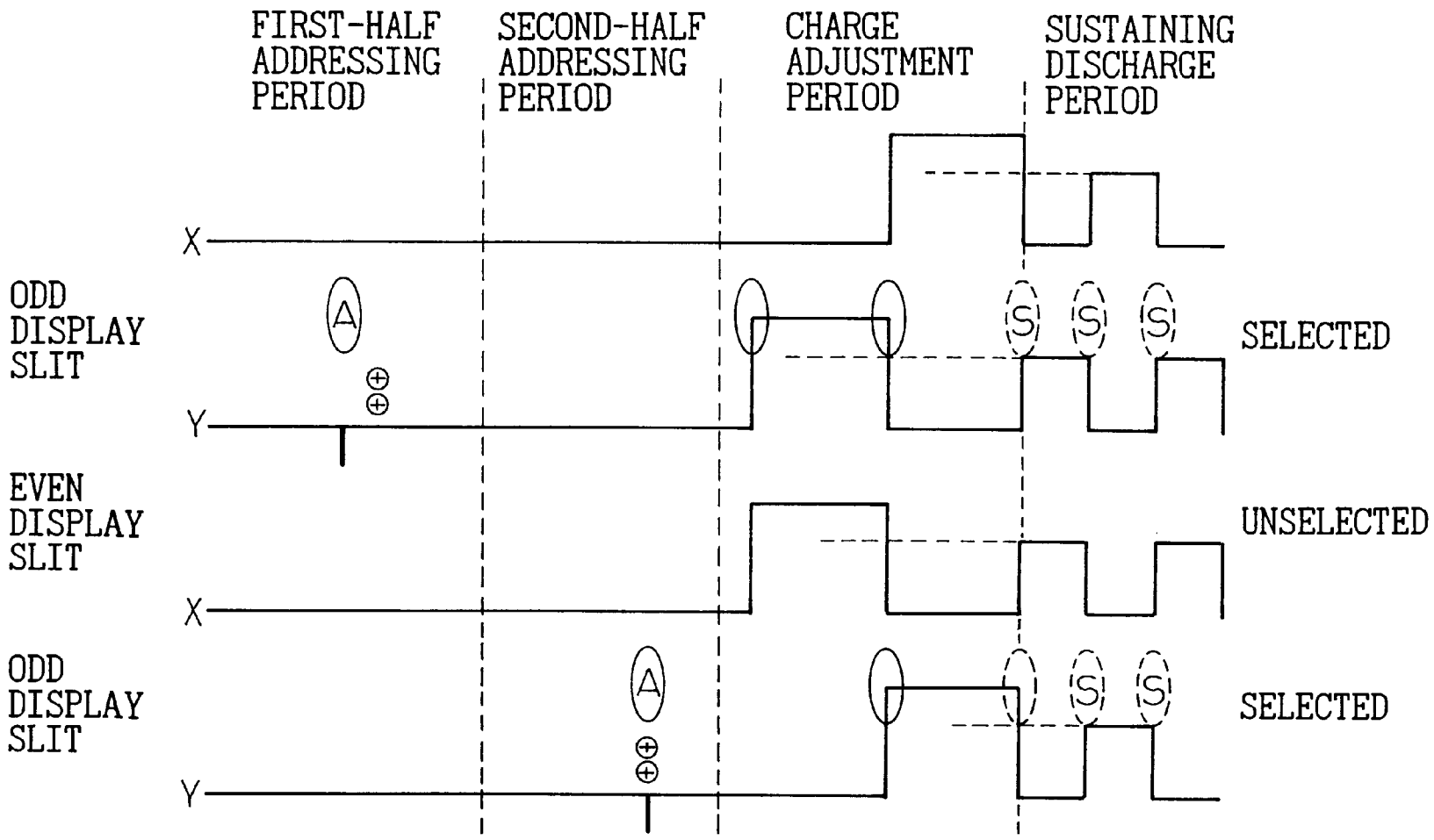
FIG. 16 is a timing chart showing the waveforms of driving signals employed in the ninth embodiment of the present invention.

FIG. 16 is a diagram showing a sequence of driving a PDP in accordance with the ninth embodiment of the present invention. In the ninth embodiment, the voltage of a charge adjustment pulse to be applied during the charge adjustment period is higher than that in the eighth embodiment. In the eighth embodiment, as mentioned above, addressing discharge is limited to an opposed discharge that is discharge initiated in the regions defined between an Y electrode and address electrode. The produced wall charge is therefore small and sustaining discharge hardly occurs. In the ninth embodiment, the voltage of the charge adjustment pulse is made high enough to initiate initial discharge. Once discharge occurs, subsequent sustaining discharge pulses may have the voltage conventionally adopted.

Figure 17:
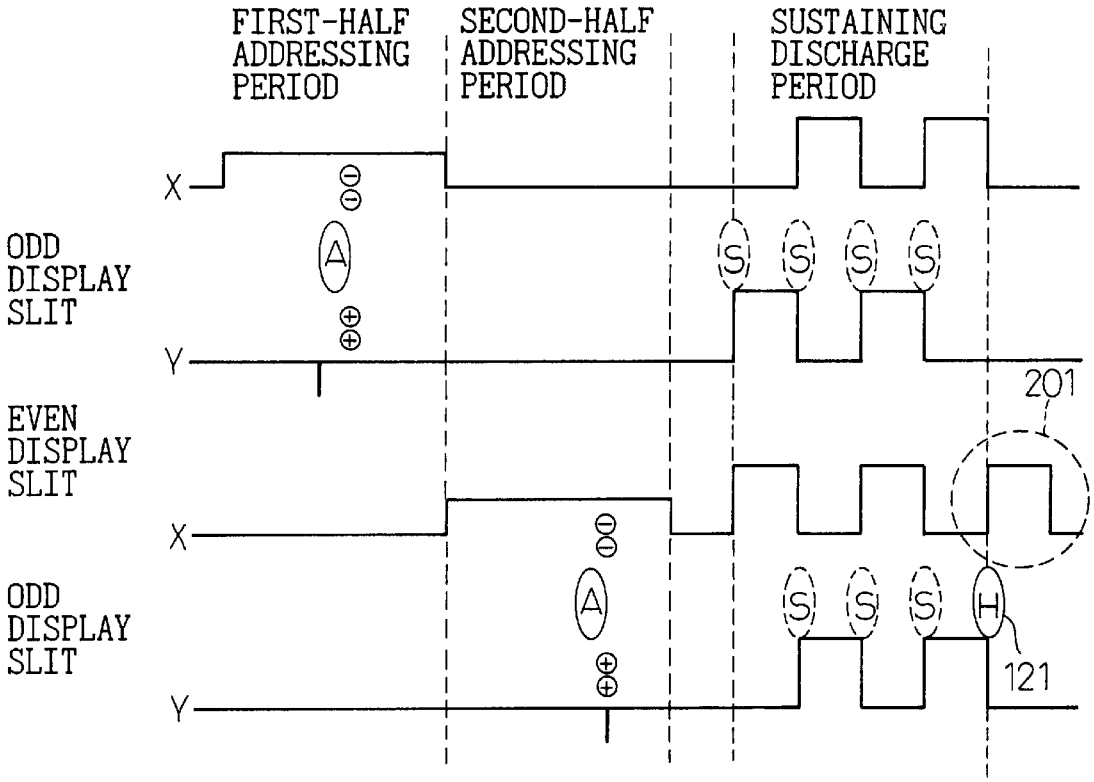
FIG. 17 is a timing chart showing the waveforms of driving signals employed in the tenth embodiment of the present invention.

FIG. 17 is a diagram showing a sequence of driving a PDP in accordance with the tenth embodiment of the present invention. In the tenth embodiment, the number of glows occurring in a slit in which display cells are addressed during the first-half addressing period agrees with the number of glows occurring in a slit in which display cells are addressed during the second-half addressing period. As apparent from the comparison with the prior art shown in FIG. 5, in the tenth embodiment, a frequency adjustment pulse is applied after the completion of the sustaining discharge period so that discharge will be initiated only in a slit in which sustaining discharge has occurred a small number of times. Consequently, the frequencies of glow occurring in both the slits agree with each other. Specifically, in the drawing, the frequency of discharge occurring in an odd-numbered odd display slit during the sustaining discharge period is four times. The frequency of discharge occurring in an even-numbered odd display slit is three times. After the completion of the sustaining discharge period, a frequency adjustment pulse 201 is applied to the even-numbered odd display slit. Thus, discharge is initiated in the even-numbered odd display slit alone. At this time, a voltage is applied to even display slits. However, since accumulated charges work to decrease the voltage, no discharge occurs.

Figure 18:
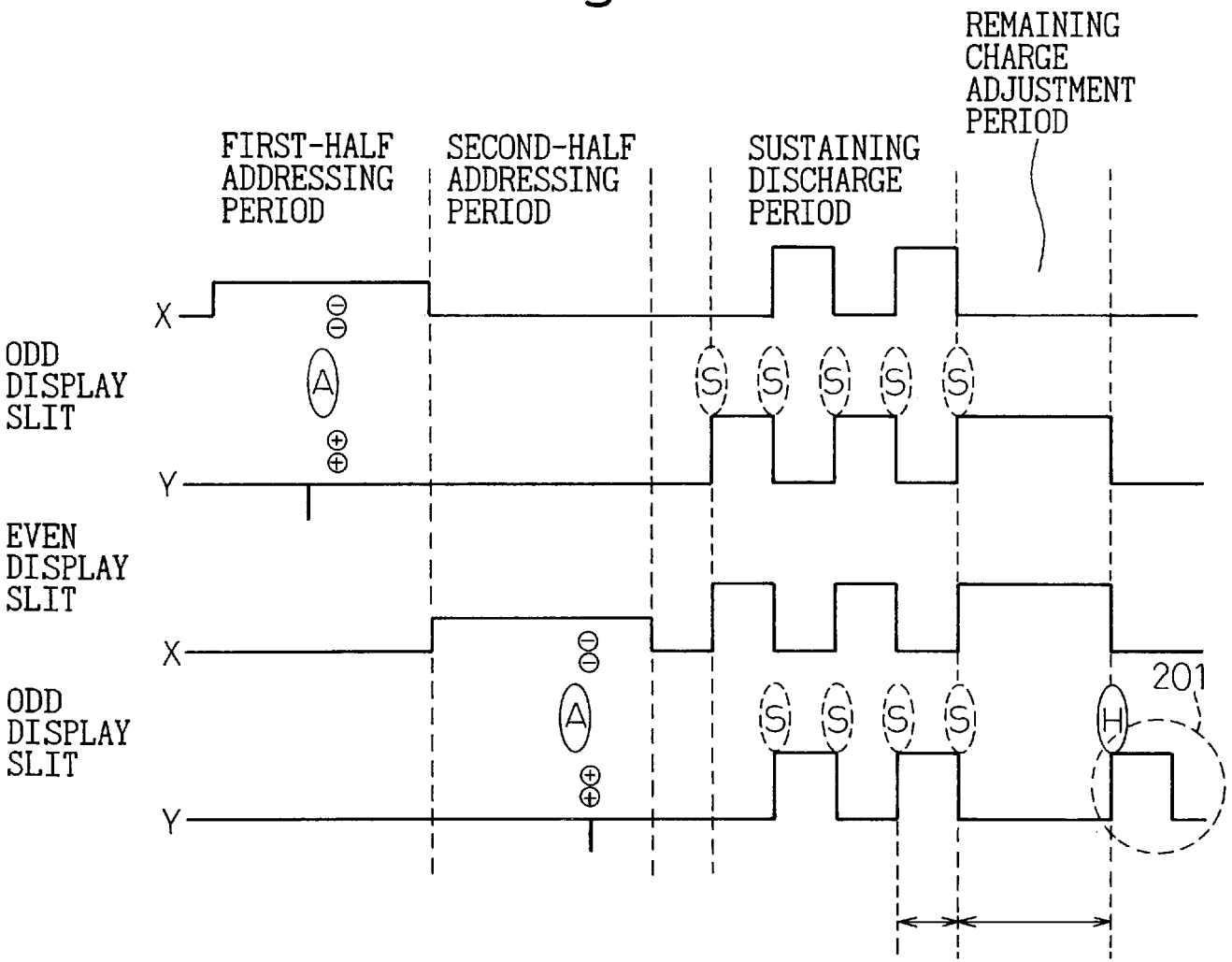
FIG. 18 is a timing chart showing the waveforms of driving signals employed in the eleventh embodiment of the present invention.

FIG. 18 is a diagram showing a sequence of driving a PDP in accordance with the eleventh embodiment of the present invention. In the eleventh embodiment, application of the frequency adjustment pulse 201 is preceded by a remaining charge adjustment period. The remaining charge adjustment period is a period coincident with the long duration of the last pulse that used to be applied during the sustaining discharge period. Owing to the remaining charge adjustment period, disappearance of a charge or incorrect writing deriving from the adverse effect of sustaining discharge upon a display slit in which discharge is not initiated can be overcome. Eventually, a reset can be carried out satisfactorily.

Figure 19:
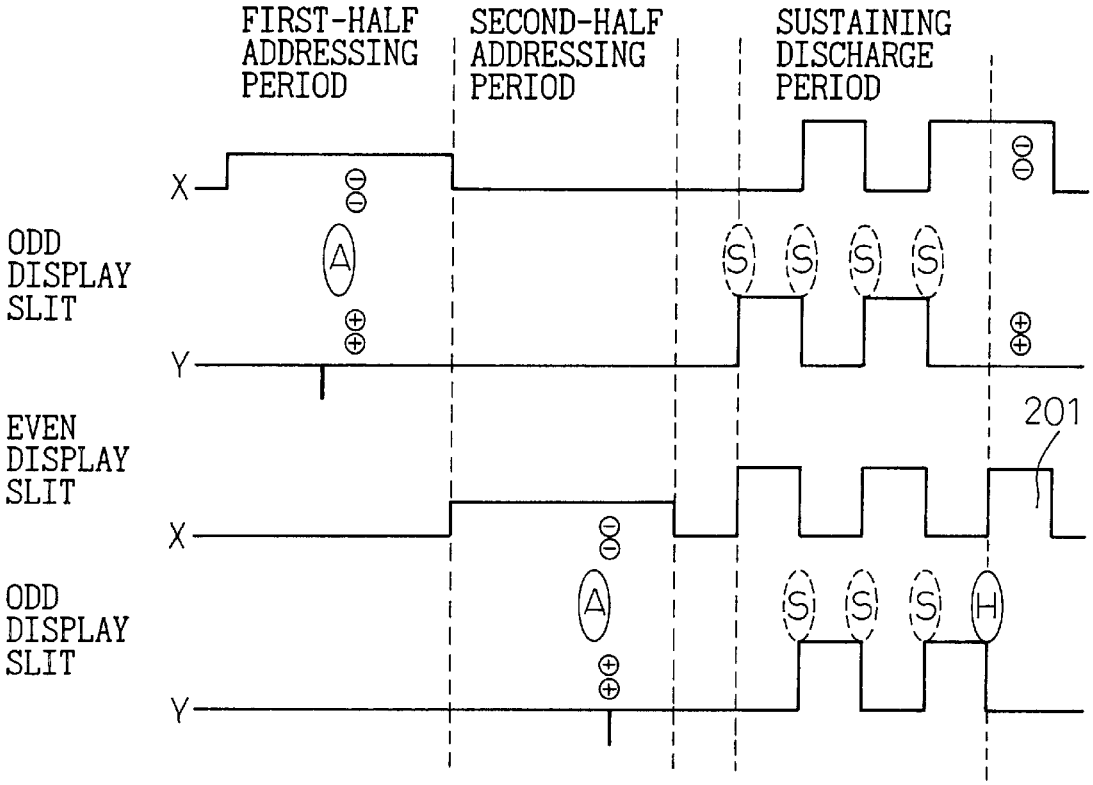
FIG. 19 is a timing chart showing the waveforms of driving signals employed in the twelfth embodiment of the present invention.

FIG. 19 is a diagram showing a sequence of driving a PDP in accordance with the twelfth embodiment of the present invention. According to the twelfth embodiment, when the frequency adjustment pulse 201 is applied to one slit in which discharge has occurred by a smaller number of times, according to the tenth embodiment, a pulse for preventing loss of a charge is applied to the other slit. This results in satisfactory erase at the subsequent erasing step.

Figure 20:
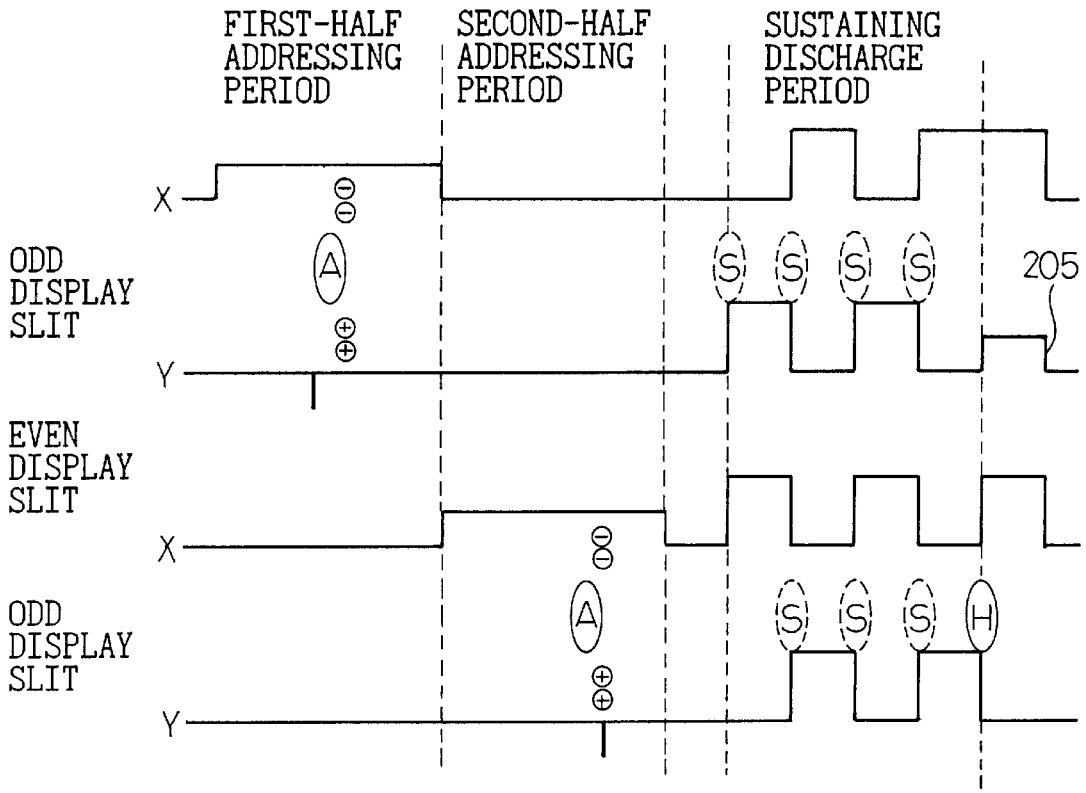
FIG. 20 is a timing chart showing the waveforms of driving signals employed in the thirteenth embodiment of the present invention.

FIG. 20 is a diagram showing a sequence of driving a PDP in accordance with the thirteenth embodiment of the present invention. In the thirteenth embodiment, when the frequency adjustment pulse is applied to one slit, in which discharge has occurred by a smaller number of times, according to the tenth embodiment, a pulse 205 for preventing loss of a charge and lowering the voltage of charges in another slits is applied to the other slit. Specifically, as illustrated, a high voltage is applied to an X electrode defining an even-numbered odd display slit, and 0 V is applied to a Y electrode defining it. A high voltage is applied to an X electrode defining an odd-numbered odd display slit, and an intermediate voltage is applied to a Y electrodes defining it. Consequently, a charge in the odd-numbered odd display slit is held reliably. Occurrence of discharge in an even display slit can be reliably prevented.

As described above, according to the present invention, there is provided a drive method for high-definition plasma display panels in which sustaining discharge pulses that are mutually out of phase are applied to adjoining slits in order to initiate sustaining discharge and to thus specify display slits between an Y electrode and X electrodes across the Y electrode. According to the drive method, a normal display can be achieved on a stable basis.

What is claimed is:

1. A drive method for a plasma display device which has a display panel including first and second electrodes arranged in parallel with one another and third electrodes arranged to be orthogonal to said first and second electrodes, and in which a slit coincident with a line formed by discharge cells is selected by applying a scanning pulse and addressing signal to second and third electrodes at an addressing step, and sustaining discharge is initiated in the selected slit by applying sustaining discharge pulses to the first and second electrodes at a sustaining discharge step, wherein:

sustaining discharge pulses that are mutually out of phase are applied alternately to adjoining ones of said first electrodes and adjoining ones of said second electrodes, whereby a first slit is defined between a second electrode and a first electrode on one side of the second electrode, and a second slit is defined between the second electrode and a first electrode on the other side of said second electrode; and interlacing, where said first slits and second slits are allowed to alternately and repeatedly glow for display is carried out, said drive method comprising:

a charge adjustment step being set between said addressing step and sustaining discharge step in order to apply a charge adjustment pulse that is used to adjust at least one of the polarity and magnitude of a wall charge accumulated due to discharge occurring at said addressing step.

2. A drive method for a plasma display device according to claim 1, wherein the duration of said charge adjustment pulse is longer than the duration of said sustaining discharge pulse.

3. A drive method for a plasma display device according to claim 1, wherein each of addressing steps at which the display cells lying in said first slit and second slit respectively are addressed includes a first-half addressing step and second-half addressing step at which lines coincident with said respective slits are interlaced, and said charge adjustment step is preceded by said first-half addressing step.

4. A drive method for a plasma display device according to claim 3 wherein, during a period after said addressing step is completed until said sustaining discharge step is started, a state in which said charge adjustment pulse that is opposite in polarity to said wall charge produced at said addressing step has been applied is retained.

5. A drive method for a plasma display device according to claim 1, wherein each of addressing steps at which the display cells lying in said first slit and second slit respectively are addressed includes a first-half addressing step and second-half addressing step at which lines coincident with said respective slits are interlaced, and a charge adjustment pulse is applied so that discharge will be started simultaneously in said slits selected at said first-half addressing step and second-half addressing step respectively.

6. A drive method for a plasma display device according to claim 1, wherein each of addressing steps at which the display cells lying in said first slit or second slit respectively are addressed includes a first-half addressing step and second-half addressing step at which lines coincident with said respective slits are interlaced, and a charge adjustment pulse is applied so that discharge will be started in said slits selected at said first-half addressing step and second-half addressing step respectively at different time instants.

7. A drive method for a plasma display device according to claim 6 wherein, during said charge adjustment period, a charge adjustment pulse that is opposite in polarity to a wall charge produced at said addressing step and a wall charge produced with said charge adjustment pulse is applied to lines other than lines coincident with said first slit and second slit in which discharge is initiated.

8. A drive method for a plasma display device according to claim 7, wherein during said charge adjustment period, when discharge is initiated in one of said first slit and second slit, a charge adjustment pulse whose voltage is lower is applied to the other slit.

9. A drive method for a plasma display device according to claim 1, wherein each of addressing steps at which the display cells lying in said first slit and second slit respectively are addressed includes a first-half addressing step and second-half addressing step at which lines coincident with said respective slits are interfaced, and a charge adjustment pulse is applied so that discharge will be initiated first in the slit in which a wall charge of a smaller magnitude is accumulated due to discharge occurring at said first-half addressing step or second-half addressing step.

10. A drive method for a plasma display device according to claim 1, wherein an equal voltage is applied to said first electrodes at said addressing step, and said charge adjustment pulse is used to select either a line coincident with said first slit or a line coincident with said second slit as a line to be displayed.

11. A drive method for a plasma display device according to claim 10, wherein discharge occurring at said addressing step is initiated only in the regions defined between second and third electrodes.

12. A drive method for a plasma display device according to claim 10, wherein the voltage of said charge adjustment pulse is higher than the voltage of said sustaining discharge pulse.

13. A drive method for a plasma display device which has a display panel including first and second electrodes arranged in parallel with one another and third electrodes arranged to be orthogonal to said first and second electrodes, and in which a slit coincident with a line formed by discharge cells is selected by applying a scanning pulse and addressing signal to second and third electrodes at an addressing step, and sustaining discharge is initiated in the selected slit by applying sustaining discharge pulses to the first and second electrodes at a sustaining discharge step, wherein:

sustaining discharge pulses that are mutually out of phase are applied alternately to adjoining ones of said first electrodes and adjoining ones of said second electrodes, whereby a first slit is defined between a second electrode and a first electrode on one side of said second electrode, and a second slit is defined between the second electrode and a first electrode on the other side of the second electrode;

interlacing, where said first slits and second slits are allowed to alternately and repeatedly glow for display, is carried out;

each of the addressing steps at which the display cells lying in said first slit and second slit respectively are addressed includes a first-half addressing step and second-half addressing step at which lines coincident with said respective slits are interlaced; and said sustaining discharge step is succeeded by a number-of-glow adjustment step at which the number of glows occurring in slits at said first-half addressing step and second-half addressing step, either of which is smaller, agrees with each other.

14. A drive method for a plasma display device which has a display panel including first and second electrodes arranged in parallel with each other and third electrodes arranged to be orthogonal to said first and second electrodes, and in which a slit coincident with a line formed by discharge cells is selected by applying a scanning pulse and addressing signal to second and third electrodes at an addressing step, and sustaining discharge is initiated in the selected slit by applying sustaining discharge pulses to the first and second electrodes at a sustaining discharge step, wherein:

sustaining discharge pulses that are mutually out of phase are applied to adjoining ones of said first electrodes and adjoining ones of said second electrodes, whereby a first slit is defined between a second electrode and a first electrode on one side of the second electrode, and a second slit is defined between the second electrode and a first electrode on the other side of the second electrode;

interlacing, where said first slits and second slits are allowed to alternately and repeatedly glow for display, is carried out;

said sustaining discharge step is succeeded by a remaining charge adjustment step at which a remaining charge adjustment pulse is applied in order to adjust at least one of the polarity and magnitude of a charge remaining at the time of completion of said sustaining discharge step before the remaining charge is deleted at a deletion step.

15. A drive method for a plasma display device according to claim 13, wherein the duration of said sustaining discharge pulse to be applied immediately before application of said remaining charge adjustment pulse is longer than the duration of the other sustaining discharge pulses.

16. A drive method for a plasma display device according to claim 14, wherein the duration of said sustaining discharge pulse to be applied immediately before application of said remaining charge adjustment pulse is longer than the duration of the other sustaining discharge pulses.

17. A drive method for a plasma display device according to claim 13, wherein a pulse that is opposite in polarity to a charge produced at said sustaining discharge step is applied to slits other than a slit in which discharge is initiated with said remaining charge adjustment pulse.

18. A drive method for a plasma display device according to claim 14, wherein a pulse that is opposite in polarity to a charge produced at said sustaining discharge step is applied to slits other than a slit in which discharge is initiated with said remaining charge adjustment pulse.

19. A drive method for a plasma display device according to claim 17, wherein a lower voltage is applied to slits other than a slit in which discharge is initiated with said remaining charge adjustment pulse.

20. A drive method for a plasma display device according to claim 18, wherein a lower voltage is applied to slits other than a slit in which discharge is initiated with said remaining charge adjustment pulse.

* * * * *

UNITED STATES PATENT AND TRADEMARK OFFICE

CERTIFICATE OF CORRECTION

PATENT NO.: 6,084,558
DATED : July 4, 2000
INVENTOR(S): Noriaki SETOGUCHI et al.

It is certified that error appears in the above-identified patent and that said Letters Patent is hereby corrected as shown below:

On the title page, [30] Foreign Application Priority Data, change "1997" to --1998--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*